US008933009B2

(12) United States Patent
Schacht et al.

(10) Patent No.: US 8,933,009 B2
(45) Date of Patent: Jan. 13, 2015

(54) SURFACTANT BLENDS FOR CLEANING FILTRATION MEMBRANES

(71) Applicant: Ecolab USA Inc., St. Paul, MN (US)

(72) Inventors: Paul Schacht, Oakdale, MN (US); Jeffrey Weilage, Burnsville, MN (US); Eric Schmidt, Woodbury, MN (US); Joseph P. Curran, Forest Lake, MN (US); Ralf Krack, Humboldstrasse 86 (DE); Victor Fuk-Pong Man, St. Paul, MN (US); Charles Allen Hodge, Cottage Grove, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 13/796,473

(22) Filed: Mar. 12, 2013

(65) Prior Publication Data

US 2014/0274857 A1 Sep. 18, 2014

(51) Int. Cl.

| | |
|---|---|
| ***C11D 1/825*** | (2006.01) |
| ***C11D 3/37*** | (2006.01) |
| ***C11D 1/12*** | (2006.01) |
| ***C11D 1/66*** | (2006.01) |
| ***C11D 1/72*** | (2006.01) |
| ***C11D 1/75*** | (2006.01) |

(52) U.S. Cl.

CPC ..... *C11D 3/3707* (2013.01); *C11D 1/12* (2013.01); *C11D 1/662* (2013.01); *C11D 1/72* (2013.01); *C11D 1/75* (2013.01)

USPC ..... 510/218; 510/162; 510/234; 510/356; 510/421; 510/422; 510/426; 510/427; 510/432

(58) Field of Classification Search

USPC ..... 510/162, 234, 218, 356, 426, 427, 421, 510/422, 432

See application file for complete search history.

(56) References Cited

U.S. PATENT DOCUMENTS

| | | | | |
|---|---|---|---|---|
| 7,220,358 | B2 | 5/2007 | Schacht et al. | |
| 8,062,381 | B2 | 11/2011 | Shamayeli et al. | |
| 8,278,259 | B2 | 10/2012 | Shamayeli et al. | |
| 2003/0015219 | A1* | 1/2003 | Kravitz et al. | 134/2 |
| 2004/0140259 | A1 | 7/2004 | Cummings | |
| 2005/0126599 | A1* | 6/2005 | Labib et al. | 134/22.11 |
| 2006/0089281 | A1 | 4/2006 | Gibson | |
| 2008/0031970 | A1 | 2/2008 | Benedict et al. | |
| 2008/0169006 | A1 | 7/2008 | Musale et al. | |
| 2008/0221006 | A1 | 9/2008 | Heisig et al. | |
| 2008/0264454 | A1* | 10/2008 | Tabani et al. | 134/22.18 |
| 2010/0000579 | A1 | 1/2010 | Reinbold et al. | |
| 2011/0259367 | A1* | 10/2011 | Ahmed et al. | 134/10 |
| 2011/0312865 | A1 | 12/2011 | Hodge et al. | |
| 2012/0289448 | A1 | 11/2012 | Man et al. | |

FOREIGN PATENT DOCUMENTS

| | | | |
|---|---|---|---|
| WO | 0017303 | A1 | 3/2000 |
| WO | WO 2012/134987 | A1 | 10/2012 |

OTHER PUBLICATIONS

Brink, L.E.S. et al., "Reducing the Protein Fouling of Polysulfone Surfaces and Polysulfone Ultrafiltration Membranes: Optimization of the Type of Preabsorbed Layer", Desalination, 78 (1990), 209-233.

Fane, A. G. et al., "The Effect of Surfactant Pretreatment on the Ultrafiltration of Proteins" Desalination, 53 (1985) 37-55.

Luo, Jianquan et al., "Flux decline control in nanofiltration of detergent wastewater by a shear-enhanced filtration system" Chemical Engineering Journal 181-182 (2012) 397-406.

Samper, E. et al., "Removal of metal ions at low concentration by miscellar-enhanced ultrafiltration (MEUF) using sodium dodecyl sulfate (SDS) and linear alkylbenzene sulfonate (LAS)", Separation and Purification Technology 65 (2009) 337-342.

Xiarchos, Ioannis et al., "Interaction behavior in ultrafiltration of nonionic surfactant micelles by adsorption", Journal of Colloid and Interface Science 299 (2006) 102-111.

Ecolab USA Inc., PCT/US2014/019971 filed Mar. 3, 2014, "Notification of Transmittal of The International Search Report and The Written Opinion of The International Searching Authority, or The Declaration" mailed Jun. 26, 2014.

* cited by examiner

*Primary Examiner* — Charles Boyer
(74) *Attorney, Agent, or Firm* — McKee, Voorhees & Sease

(57) ABSTRACT

The present invention relates to the field of membrane separation processes and clean in place compositions for cleaning such membranes. The cleaning compositions can remove proteins, fats, and other food, beverage, and brewery based soils and offer an environmentally friendly alternative surfactant system to NPE. According to the invention, surfactants and polymers useful for this process are unpredictable and specific surfactants, polymers, and combinations of the same are disclosed for use alone, as part of a cleaning composition. Methods of use of the same are also included.

8 Claims, 14 Drawing Sheets

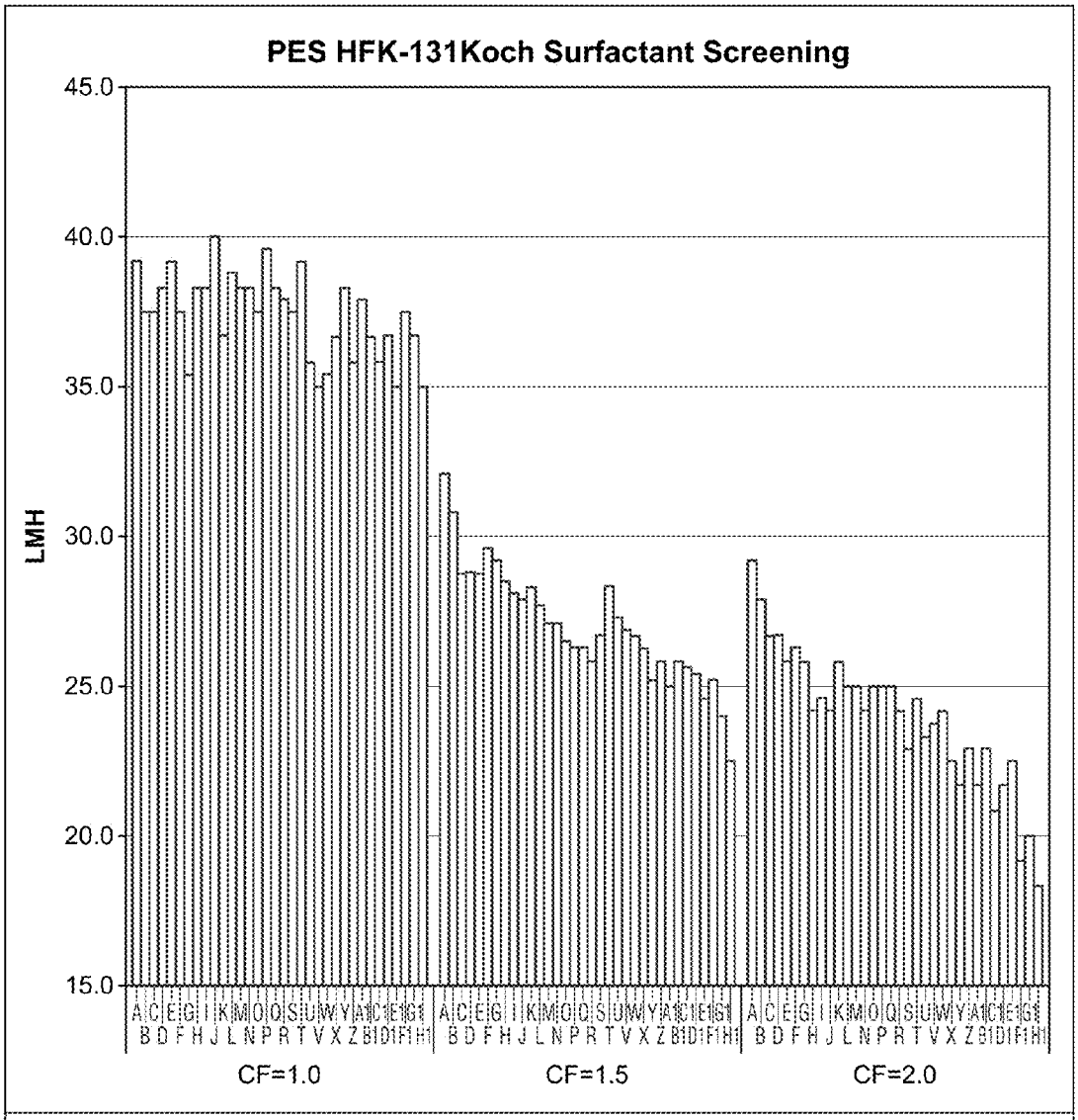

A-PEG 1450/Alkyl C6 Glycoside Blend
B-Alkyl C6 Glycoside
C-U110+No LAS+Cl2
D-PEG 1450
E-LAEO C9-11, 6EO
F-Guerbet XP-50
G-PEG 4000
H-PCS
I-Guerbet XP-40
J-PEG 1450/Guerbet XP-50 Blend
K-PEG 1450/Alkyl C6 Glucoside w/ U110
L-APG/Guerbet XP-50 Blend
M-Guerbet XP-80
N-PEG 1450/LAEO 91-6 Blend
O-Guerbet XL-70
P-LAEO C9-11, 8EO/6EO 50/50 Blend
Q-PEG 300
R-U110+No LAS 300LMH
S-U01 (NPE-9.5) Test 2
T-U01 (NPE-9.5)
U-PEG 1450/Alkyy C6 Glycoside/Guerbet XP-50 (40/40/20) Blend
V-LAS
W-LAEO C9-11, 8EO
X-Polysorbate 20
Y-Guerbet XL-50
Z-APG
A1-LAEO 91-6/Alkyl C6 Glycoside Blend
B1-DOSS
C1-LAEO C12-15, 7EO
D1-LAEO 91-6/Guerbet XP-50 Blend
E1-AOS
F1-U02 (AO)
G1-U06 (TDA-9) Test 2
H1-U06 (TDA-9)

*FIG. 2*

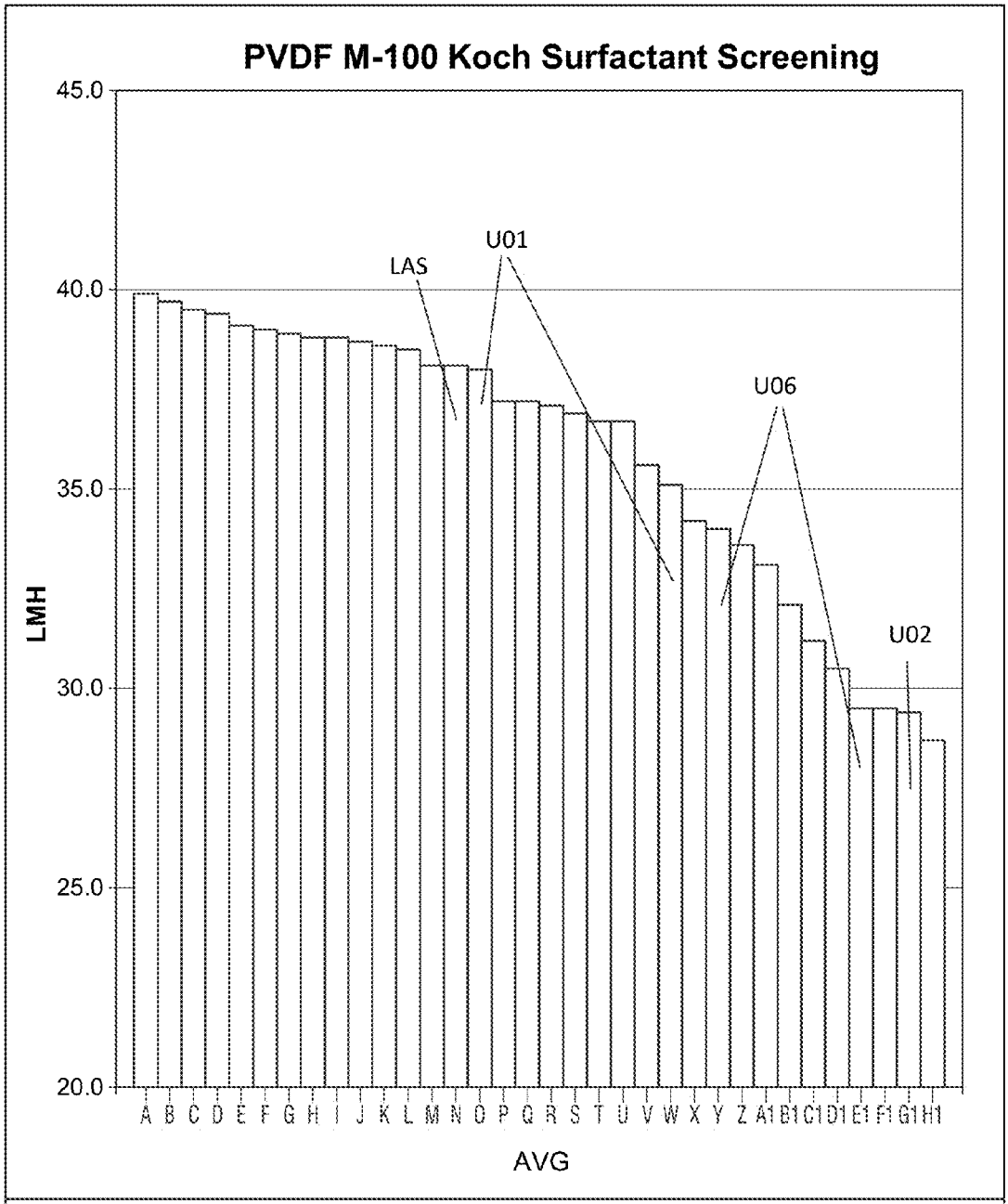

A-PEG 1450
B-LAEO C9-11, 6EO
C-PEG 1450/Alkyl C6 Glucoside Blend
D-Guerbet XP-50
E-PCS
F-Guerbet XL-70
G-APG/Guerbet XP-50 Blend
H-Alkyl C6 Glucoside
I-PEG 1450/Guerbet XP-50 Blend
J-PEG 1450/Alkyl C6 Glucoside w/U110
K-Guerbet XP-80
L-PEG 1450/LAEO 91-6 Blend
M-Guerbet XP-40
N-LAS
O-U01 (NPE-9.5) Test 2
P-LAEO C9-11, 8EO
Q-PEG 1450/Alkyy C6 Glycoside/Guerbet XP-50 (40/40/20) Blend
R-LAEO 91-6/Guerbet XP-50 Blend
S-PEG 4000
T-LAEO 91-6/Alkyl C6 Glycoside Blend
U-LAEO C9-11, 8EO/6EO 50/50 Blend
V-Guerbet XL-50
W-U110+No LAS+Cl2
X-U01 (NPE-9.5)
Y-APG
Z-U06 (TDA-9) Test 2
A1-DOSS
B1-PEG 300
C1-U110+No LAS 300LMH
D1AOS
E1-LAEO C12-15, 7EO
F1-U06 (TDA-9)
G1-U02 (AO)
H1-Polysorbate 20

*FIG. 3*

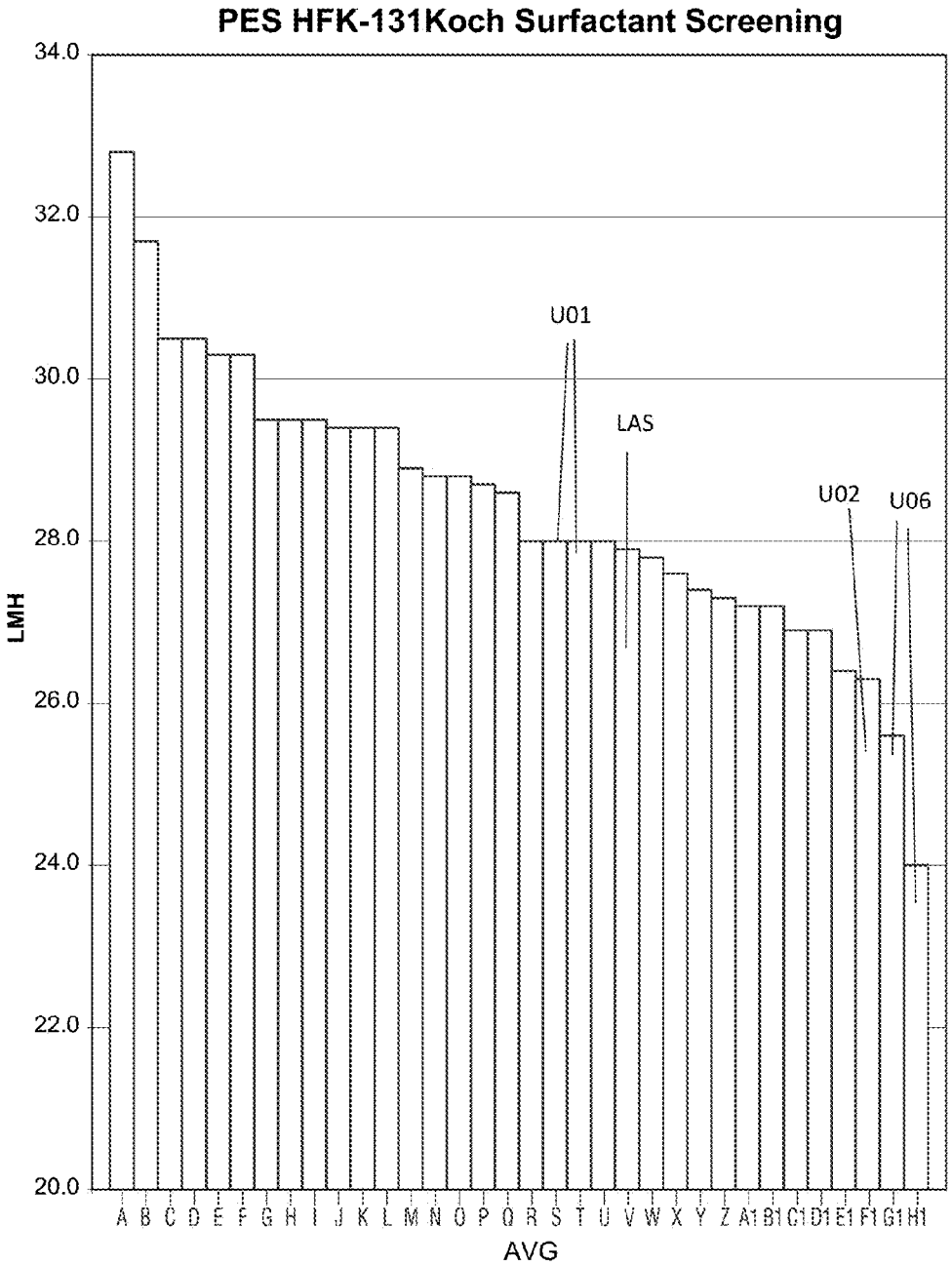

A-PEG 1450/Alkyl C6 Glycoside Blend
B-Alkyl C6 Glycoside
C-U110+No LAS+Cl2
D-PEG 1450
E-LAEO C9-11, 6EO
F-Guerbet XP-50
G-PEG 4000
H-PCS
I-Guerbet XP-40
J-PEG 1450/Guerbet XP-50 Blend
K-PEG 1450/Alkyl C6 Glucoside w/ U110
L-APG/Guerbet XP-50 Blend
M-Guerbet XP-80
N-PEG 1450/LAEO 91-6 Blend
O-Guerbet XL-70
P-LAEO C9-11, 8EO/6EO 50/50 Blend
Q-PEG 300
R-U110+No LAS 300LMH
S-U01 (NPE-9.5) Test 2
T-U01 (NPE-9.5)
U-PEG 1450/Alkyy C6 Glycoside/Guerbet XP-50 (40/40/20) Blend
V-LAS
W-LAEO C9-11, 8EO
X-Polysorbate 20
Y-Guerbet XL-50
Z-APG
A1-LAEO 91-6/Alkyl C6 Glycoside Blend
B1-DOSS
C1-LAEO C12-15, 7EO
D1-LAEO 91-6/Guerbet XP-50 Blend
E1-AOS
F1-U02 (AO)
G1-U06 (TDA-9) Test 2
H1-U06 (TDA-9)

*FIG. 4*

SURFACTANT BLENDS FOR CLEANING FILTRATION MEMBRANES

FIELD OF THE INVENTION

The invention relates to methods and compositions for cleaning membranes used in separation facilities. The cleaning compositions can remove proteins and offer an environmentally friendly alternative surfactant system to nonyl phenol ethoxylate (NPE). The application includes a surfactant additive or booster system that can form part of a cleaning composition or can be used alone for improving the cleaning properties of cleaning solutions as well as improve the performance of the membrane by cleaning the surface and minimizing subsequent protein or soil fouling during the following processing run.

BACKGROUND OF THE INVENTION

Membranes provided within a separation facility can be treated using clean-in-place (CIP) methods to provide flushing, rinsing, pretreatment, cleaning, sanitizing and preserving, as filtration membranes have a tendency to foul during processing. Fouling manifests itself as a decline in flux with time of operation. Flux decline is typically a reduction in permeation flow or permeation rates that occurs when all operating parameters, such as pressure, feed flow rate, temperature, and feed concentration are kept constant. In general, membrane fouling is a complicated process and is believed to occur due to a number of factors including electrostatic attraction, hydrophobic and hydrophilic interactions, the deposition and accumulation of feed components, e.g., suspended particulates, impermeable dissolved solutes, and even normally permeable solutes, on the membrane surface and/or within the pores of the membrane. It is expected that almost all feed components will foul membranes to a certain extent. See Munir Cheryan, Ultrafiltration and Microfiltration Handbook, Technical Publication, Lancaster, Pa., 1998 (Pages 237-288). Fouling components and deposits can include inorganic salts, particulates, microbials and organics.

Filtration membranes typically require periodic cleaning to allow for successful industrial application within separation facilities such as those found in the food, dairy, and beverage industries. The filtration membranes can be cleaned by removing foreign material from the surface and body of the membrane and associated equipment. The cleaning procedure for filtration membranes can involve a clean-in-place CIP process where cleaning agents are circulated over the membrane to wet, penetrate, dissolve and/or rinse away foreign materials from the membrane. Various parameters that can be manipulated for cleaning typically include time, temperature, mechanical energy, chemical composition, chemical concentration, soil type, water type, hydraulic design, and membrane materials of construction.

Chemical energy in the form of detergents and cleaners can be used to solubilize or disperse the foulant or soil. Thermal energy in the form of heat can be used to help the action of the chemical cleaners. In general, the greater the temperature of the cleaning the solution, the more effective it is as a cleaning treatment, although most membrane materials have temperature limitations due to the material of construction. Many membranes additionally have chemical limitations. Mechanical energy in the form of high velocity flow also contributes to the successful cleaning of membrane systems. See Munir Cheryan, Ultrafiltration and Microfiltration Handbook, Technical Publication, Lancaster, Pa., 1998, pages 237-288.

In general, the frequency of cleaning and type of chemical treatment performed on the membrane has been found to affect the operating life of a membrane. It is believed that the operating life of a membrane can be decreased as a result of chemical degradation of the membrane over time. Various membranes are provided having temperature, pH, and chemical restrictions to minimize degradation of the membrane material. For example, many polyamide reverse osmosis membranes have chlorine restrictions because chlorine can have a tendency to oxidatively attack and damage the membrane. Cleaning and sanitizing filtration membranes is desirable in order to comply with laws and regulations that may require cleaning in certain applications (e.g., the food and biotechnology industries), reduce microorganisms to prevent contamination of the product streams, and optimize the process by restoring flux. See Munir Cheryan, Ultrafiltration and Microfiltration Handbook, Technical Publication, Lancaster, Pa., 1998, pages 237-288.

Other exemplary techniques for cleaning filtration membranes are disclosed by U.S. Pat. No. 4,740,308 to Fremont et al.; U.S. Pat. No. 6,387,189 to Groschl et al.; U.S. Pat. No. 6,071,356 to Olsen; and Munir Cheryan, Ultrafiltration and Microfiltration Handbook, Technical Publication, Lancaster, Pa., 1998 (Pages 237-239).

It is believed that membrane performance declines dining processing of milk, whey, and other feed streams due to the fouling of the membrane surface or membrane pores by protein, fat, minerals, and other feed stream components.

The fouling of membranes processing high solid feed streams therefore require that they are cleaned regularly using a clean-in-place (CIP) approach in which the use of alkaline, acid, and cleaning adjuvants such as surfactants and water conditioning polymers aid in the cleaning of the foulants and restore the membrane for functional use.

The proper use of alkaline, acid, and adjuvants requires an understanding of the functionality of the chemistry used. As an example, too high in pH or too low in pH can damage the polymeric membrane material. The use of solvents or overuse of surfactants can often time lead to destruction of the glue line causing the membrane to delaminate rendering it nonfunctional. Overusing oxidative chemicals such as sodium hypochlorite (chlorine bleach) or hydrogen peroxide can Irreversibly damage some polymeric membrane types.

Conventional cleaning compositions used in CIP protocols, particularly those intended for institutional use, often contain alkyl phenol ethoxylates (APEs). APEs are used in cleaning compositions as a cleanser and a degreaser for their effectiveness at removing a variety of soils from a variety of surfaces. Commonly used APEs include nonyl phenol ethoxylates (NPE) surfactants such as NPE 9.5 or nonoxynol-9 which is a 9.5 mole ethoxylate of nonyl phenol.

However, while effective, APEs are disfavored due to environmental concerns. For example, NPEs are formed through the combination of ethylene oxide with nonylphenol (NP). Both NP and NPEs exhibit estrogen-like properties and may contaminate water, vegetation and marine life. NPE is also not readily biodegradable and remains in the environment or food chain for indefinite time periods. There is therefore a need in the art for an environmentally friendly and biodegradable alternative that can replace APEs in membrane cleaners which allow membranes to be adequately cleaned from soils, do not cause damage to the membranes or membrane construction materials, and do not foul the membranes themselves.

SUMMARY OF THE INVENTION

The present invention relates to the field of clean in place and other membrane cleaning protocols for cleaning membranes at separation facilities. More specifically, the invention relates to a surfactant system that for use in the same that offers an environmentally safer alternative surfactant system than NPE which is currently used in many operations.

The present invention comprises a surfactant system as well as alkaline cleaning compositions incorporating the same and methods of use of the same. In one embodiment, the present invention is a surfactant component for use alone or in cleaning compositions and methods of use of the same. The choice of surfactants that will be useful in membrane cleaning is not easily predictable and typically does not easily follow general chemical and physical features such as HLB, degree of ethoxylation, linearity, branching, and the like. According to the invention, applicants have determined several surfactants and polymers, one or more of which may be used successfully in membrane cleaning protocols. The surfactant component of the invention which includes one or more surfactants or polymers selected from the following group: polyethylene glycol (molecular weight range of 300-4000), ethoxylated linear alcohol (alcohol ranging from C9 to C15 and average moles of ethoxylation of 6 to 8, an alkoxylated branched C10-Guerbet alcohol (such as the Lutensol XP and XL line of products available from BASF with 3 to 10 moles of ethoxylation, an alkyl glucoside with alkyl group of C8 to C10, an alkyl aryl sulfonate (C1 to C10), an alkyl dimethyl amine oxide (C10 to C16).

Another aspect of the present invention is to provide a cleaning composition comprising a source of alkalinity and the surfactant and/or polymer system of the invention. The source of alkalinity is such that is comprises approximately 500 ppm to 10,000 ppm actives in a use solution. The surfactant system comprises from about 0.05 weight percent to about 1.0 weight percent of actives in the cleaning solution. Additional functional ingredients such as chelants, preservatives, hydrotopes and the like may also be present. The surfactant system may be used as a part of a cleaning composition, may be used as a booster composition in combination with standard cleaning compositions, or may be used alone as part of an overall CIP process.

In another embodiment, the present invention is a method of removing soils, solutes and proteins from filtration membranes in a cleaning process. The method includes steps of removing liquid product from the filtration system, contacting the membrane with an alkaline or acid cleaning composition of the invention, or surfactant composition. This is typically achieved by circulating through the filtration system with an aqueous cleaning use solution and thereafter rinsing the filtration system.

The membranes that can be treated according to the invention include any membranes that are designed for periodic cleaning, and are often utilized in various applications requiring separation by filtration. Exemplary industries that utilize membranes that can be treated according to the invention include the food industry, the beverage industry, the biotechnology industry, the pharmaceutical industry, the chemical industry, and the water purification industry. In the case of the food and beverage industries, products including milk, whey, fruit juice, beer, and wine are often processed through a membrane for separation. The water purification industry often relies upon membranes for desalination, contaminant removal, and waste water treatment. An exemplary use of membranes in the chemical industry includes electropaint processes. This invention is particularly useful in removing proteins, fats, and minerals, such as those from whey in a milk or cheese making process.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DESCRIPTION OF THE FIGURES

FIG. 2 is a graph of a PES Membrane Milk Production Performance Flux Chart showing the different surfactant boosters of the invention compared to the traditional cleaners.

FIG. 3 is a graph of a PVDF Membrane Milk Production Average Flux Chart showing the different surfactant boosters of the invention compared to the traditional cleaners.

FIG. 4 is a graph of a PES Membrane Milk Production Average Flux Chart showing the different surfactant boosters of the invention compared to the traditional cleaners.

DETAILED DESCRIPTION OF THE INVENTION

Figure 1:
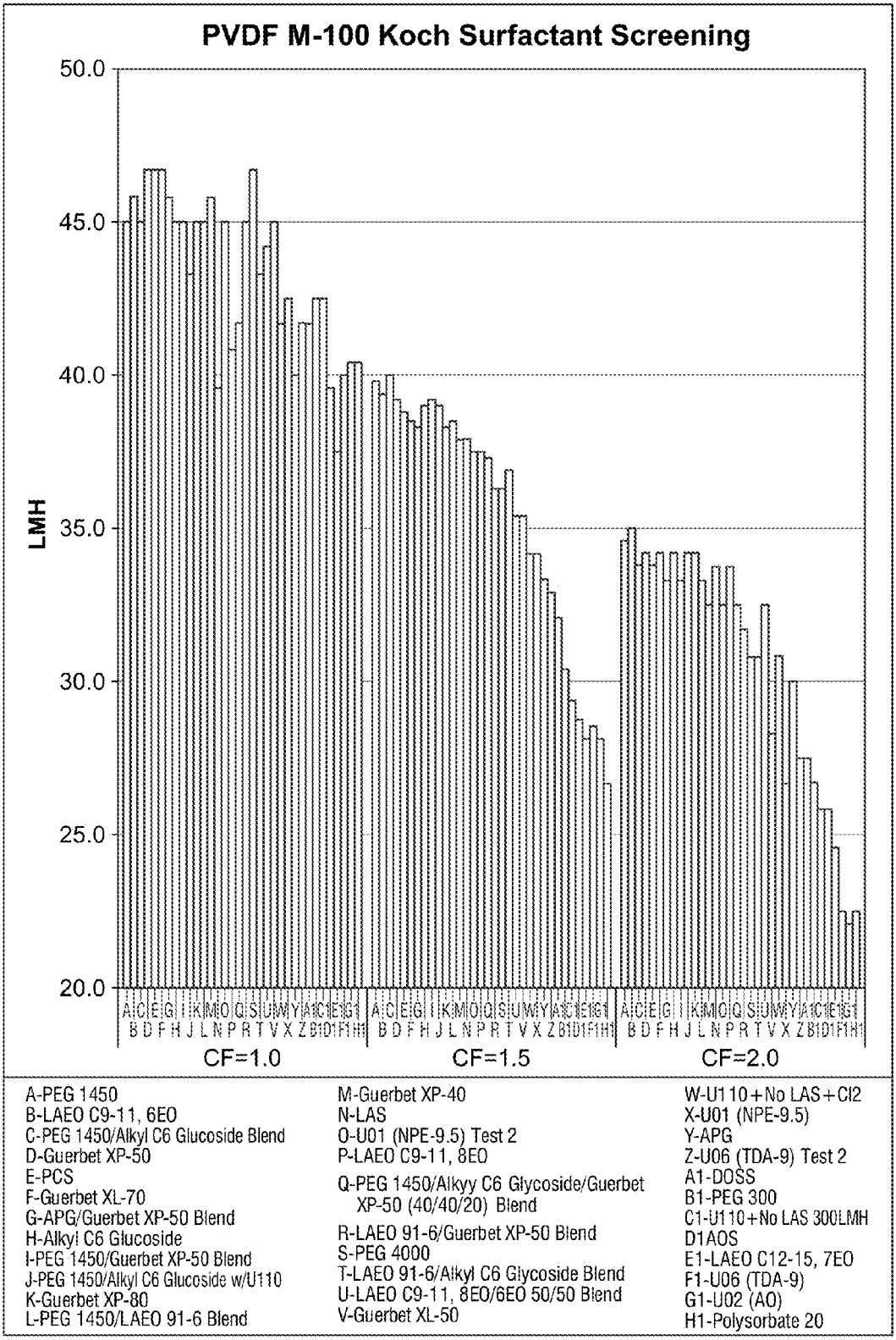
FIG. 1 is a graph of a PVDF Membrane Milk Production Performance Flux Chart showing the different surfactant boosters of the invention compared to traditional cleaners.

Other than in the operating examples, or where otherwise indicated, all numbers expressing quantities of ingredients or reaction conditions used herein are to be understood as being modified in all instances by the term "about".

As used herein, weight percent (wt-%), percent by weight, % by weight, and the like are synonyms that refer to the concentration of a substance as the weight of that substance divided by the total weight of the composition and multiplied by 100.

As used herein, the term "about" modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities.

The term "alkyl" or "alkyl groups," as used herein, refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups. In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

The term "surfactant" or "surface active agent" refers to an organic chemical that when added to a liquid changes the properties of that liquid at a surface.

"Cleaning" means to perform or aid in soil removal, bleaching, microbial population reduction, rinsing, or combination thereof.

As used herein, the term "substantially free" refers to compositions completely lacking the component or having such a small amount of the component that the component does not affect the effectiveness of the composition. The component may be present as an impurity or as a contaminant and shall be less than 0.5 wt. %. In another embodiment, the amount of the component is less than 0.1 wt-% and in yet another embodiment, the amount of component is less than 0.01 wt. %.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the terms "alkyl phenol ethoxylate-free" or "NPE-free" refers to a composition, mixture, or ingredients that do not contain alkyl phenol ethoxylates or phenol-containing compounds or to which the same has not been added. Should alkyl phenol ethoxylates or -alkyl phenol ethoxylate containing compound be present through contamination of a composition, mixture, or ingredients, the amount of the same shall be less than 0.5 wt. %. In another embodiment, the amount of is less than 0.1 wt-% and in yet another embodiment, the amount is less than 0.01 wt. %.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both, when using the substitute cleaning product or substitute cleaning system rather than a alkyl phenol ethoxylate-containing cleaning to address a typical soiling condition on a typical substrate. This degree of cleanliness may, depending on the particular cleaning product and particular substrate, correspond to a general absence of visible soils, or to some lesser degree of cleanliness, as explained in the prior paragraph.

The recitation of numerical ranges by endpoints includes all numbers subsumed within that range (e.g., 1 to 5 includes 1, 1.5, 2, 2.75, 3, 3.80, 4, and 5).

The terms "include" and "including" when used in reference to a list of materials refer to but are not limited to the materials so listed.

Surfactant/Polymer System of the Invention

The present invention comprises a surfactant system which can be used as a booster or as part of an alkaline or acid cleaning composition and methods of use of the same. The surfactants can be used as a membrane cleaning adjuvant for improved removal of proteins, fat, and other soils from membranes and in some cases improving the hydrophilicity properties of membranes and improve processing permeation properties. Other considerations for a successful surfactant system include good rinsing characteristics, low foaming, good soil removal or cleaning properties, biodegradability, and relatively low cost. The use of a membrane incompatible surfactant can cause fouling issues on membrane surfaces. For example, the use of cationic surfactants are often associated with irreversible fouling of the membrane due to the inability to rinse or wash the surfactant from the surface. It is understood that the membrane has a negative surface charge and therefore a cationic surfactant is strongly attracted to the surface and cannot be easily removed. This residual surfactant on the surface acts as a foulant causing low production and water flux rates resulting in poor production performance.

Other surfactants such as anionic surfactants (DDBSA) are considered to not be attracted to the surface due to both the membrane and surfactant being negatively charged. This is believed to improve the rinseability of the surfactant while allowing it to assist in the aid of cleaning fats and proteins due to its reduction in surface tension.

Nonionic surfactants have been sparingly used as membrane cleaning adjuvants. They typically have positive properties such as degreasing, low foaming, wetting, and reducing surface tension. However, many of the nonionic surfactants can also cause fouling problems to the membrane due to their general poor rinseability characteristics. As the nonionics are technically neutral molecules, the predictability of whether or not they will perform well as a surfactant booster on a particular membrane type is less certain. Molecular weight, hydrophilic-lipophilic-balance (HLB), branching, linearity, alcohol chain length, Draves wetting, and degree of ethoxylation alone do not adequately predict whether or not a nonionic surfactant or polymer will function well on a membrane. In addition, the membrane surface type such as polyethersulfone (PES), polyvinyldenedifluoride (PVDF) have different surface energies that also affect how a surfactant functions on the surface and how the foulant functions on the surface. The molecular weight cut-off or pore size of a particular membrane will also likely affect the functionality of a surfactant due to pore fouling, pore penetration for cleaning pores, membrane permeation exclusion due to branching and molecular weight, and ease of permeation due to linearity.

In one embodiment, the present invention is a surfactant and polymer component for use in the cleaning compositions and methods of the invention. The surfactant and polymer component is preferably a nonionic surfactant or appropriate nonionic polymer.

Surfactants/Polymers for Use in the Invention

In certain embodiments the surfactant and polymer blend includes one or more nonionic surfactants and polymers useful in the invention and are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co. This includes Guerbet alcohols such as those sold under the Lutensol name from BASF.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances.

The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_{10}$-$C_{18}$ ethoxylated fatty alcohols with a degree of ethoxylation of from 3 to 50.

Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

The treatise Nonionic Surfactants, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

In some embodiments the non-ionic surfactant is a Guerbet alcohol ethoxylate of the formula $R^1$—$(OC_2H_4)_n$—(OH), wherein $R^1$ is a branched $C_9$-$C_{20}$ alkyl group and n is from 2 to 10.

In a preferred embodiment the Guerbet alcohol ethoxylate being used in the liquid surfactant composition is a Guerbet alcohol ethoxlyate of the formula $R^1$—$(OC_2H_4)_n$—(OH), This includes a Guerbet alcohol ethoxylate where $R^1$a branched $C_{10}$ to $C_{18}$ alkyl group and n is from 5 to 10, preferably 7 to 9 and also ones wherein $R^1$ is $C_8$ to $C_{12}$ branched alkyl group, preferably branched $C_{10}$ alkyl group and n is 2 to 4, preferably 3. Such Guerbet alcohols are available, for example, under the trade name Lutensol from BASF or Eutanol G from Cognis.

The Guerbet reaction is a self-condensation of alcohols by which alcohols having branched alkyl chains are produced. The reaction sequence is related to the Aldol condensation and occurs at high temperatures under catalytic conditions. The product is a branched alcohol with twice the molecular weight of the reactant minus a mole of water. The reaction proceeds by a number of sequential reaction steps. At first the alcohol is oxidised to an aldehyde. Then Aldol condensation takes place after proton extraction. Thereafter the aldol product is dehydrated and the hydrogenation of the allylic aldehyde takes place.

These products are called Guerbet alcohols and are further reacted to the non-ionic alkoxylated guerbet alcohols by alkoxylation with i.e. ethylene oxide or propylene oxide. The ethoxylated guerbet alcohols have a lower solubility in water compared to the linear ethoxylated alcohols with the same number of carbon atoms. Therefore the exchange of linear fatty alcohols by branched fatty alcohols makes it necessary to use good solubilizers which are able to keep the guerbet alcohol in solution and the resulting emulsion stable even over a longer storage time.

In certain embodiments the surfactant compositions include one or more other suitable polymers which may be used in the surfactant compositions of the invention and include alkyl aryl sulfonates. Suitable alkyl aryl sulfonates that can be used in the cleaning composition can have an alkyl group that contains 6 to 24 carbon atoms and the aryl group can be at least one of benzene, toluene, and xylene. A suitable alkyl aryl sulfonate includes linear alkyl benzene sulfonate. A suitable linear alkyl benzene sulfonate includes linear dodecyl benzyl sulfonate that can be provided as the sulfonic acid that is neutralized to form the sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. A suitable secondary alkane sulfonate includes sodium $C_{14}$-$C_{17}$ secondary alkyl sulfonate commercially available as Hostapur SAS from Clariant.

In a preferred embodiment the surfactant system includes one or more of the following: a polyalkylene glycol, an ethoxylated alcohol, a polyalkylene glycol ether ethoxylate, an alkyl glucoside, an alkyl aryl sulfonate, an alkyl dimethyl amine oxide, and an alpha olefin sulfonate. In a more preferred embodiment the invention includes a polyethylene glycol, a linear C9-C11 alcohol ethoxylate, (preferrably with 5-6 moles of ethoxylation, a Guerbert alcohol alkoxylate, such as those sold under the tradename Lutensol® (ex. BASF AG), available in a variety of grades, preferably Lutensol XP-50, a hexyl alkyl glucoside, a linear alkyl benzene sulfonate, a lauryl dimethyl amine oxide, and an alpha olefin sulfonate.

The surfactant system may be used alone as a booster, comprising surfactant and a carrier, (such as water) or may comprise from about 0.005 weight percent to about 5.0 weight percent of actives, preferably about 0.01 weight percent to about 3.0 weight percent, and more preferably about 0.05 weight percent to about 1.0 weight percent actives as part of a cleaning composition.

Water

The booster and cleaning compositions according to the invention may comprise water in amounts that vary depending upon techniques for processing the composition.

Water provides a medium which dissolves, suspends, or carries the other components of the composition. Water can also function to deliver and wet the composition of the invention on an object.

In some embodiments, water makes up a large portion of the composition of the invention and may be the balance of the composition apart from surfactant blend, source of alkalinity, additional ingredients, and the like. The water amount and type will depend upon the nature of the composition as a whole, the environmental storage, and method of application including concentration composition, form of the composition, and intended method of delivery, among other factors. Notably the carrier should be chosen and used at a concentration which does not inhibit the efficacy of the functional components in the composition of the invention for the intended use, e.g., bleaching, sanitizing, cleaning.

In certain embodiments, the present composition includes about 5 to about 90 wt-% water, about 10 to about 80 wt. % water, about 20 to about 60 wt % water, or about 30 to about 40 wt % water. It is to be understood that all values and ranges between these values and ranges are encompassed by the present invention.

Cleaning Compositions

As indicated earlier, the surfactant blend of the composition may be formulated as part of a cleaning composition including a source of alkalinity and/or acid.

Source of Alkalinity

The cleaning composition includes an effective amount of one or more alkaline sources to enhance cleaning and improve soil removal performance. In general, it is expected that a concentrated cleaning composition will include the alkaline source in an amount of at least about 5% by weight, at least about 10% by weight, at least about 15% by weight, or at least about 25% by weight. In order to provide sufficient room for other components in the concentrate, the alkaline source can be provided in the concentrate in an amount of less than about 75% by weight, less than about 60% by weight, or less than about 50% by weight. In another embodiment, the alkalinity source may constitute between about 0.1% and about 90% by weight, between about 0.5% and about 80% by weight, and between about 1% and about 60% by weight of the total weight of the cleaning composition. In source of alkalinity is present in an amount sufficient to provide 500 ppm to about 5000 ppm actives in a use composition.

An effective amount of one or more alkaline sources should be considered as an amount that provides a use composition having a pH of at least about 8 and usually between about 9.5 and 13. When the use composition has a pH of between about 8 and about 10, it can be considered mildly alkaline, and when the pH is greater than about 13, the use composition can be considered caustic. In some circumstances, the cleaning composition may provide a use composition that is useful at pH levels below about 8. In such compositions, the alkaline source may be omitted, and additional pH adjusting agents may be used to provide the use composition with the desired pH.

Examples of suitable alkaline sources of the cleaning composition include, but are not limited to alkali metal carbonates and alkali metal hydroxides. Exemplary alkali metal carbonates that can be used include, but are not limited to: sodium or potassium carbonate, bicarbonate, sesquicarbonate, and mixtures thereof. Exemplary alkali metal hydroxides that can be used include, but are not limited to sodium, lithium, or potassium hydroxide. The alkali metal hydroxide may be added to the composition in any form known in the art, including as solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45% and a 50% by weight solution. In one embodiment, the alkali metal hydroxide is added in the form of an aqueous solution, particularly a 50% by weight hydroxide solution, to reduce the amount of heat generated in the composition due to hydration of the solid alkali material.

In addition to the first alkalinity source, the cleaning composition may comprise a secondary alkalinity source. Examples of useful secondary alkaline sources include, but are not limited to: metal silicates such as sodium or potassium silicate or metasilicate; metal carbonates such as sodium or potassium carbonate, bicarbonate, sesquicarbonate; metal borates such as sodium or potassium borate; and ethanolamines and amines. Such alkalinity agents are commonly available in either aqueous or powdered form, either of which is useful in formulating the present cleaning compositions.

The cleaning composition may be phosphorus-free and/or nitrilotriacetic acid (NTA)-free to meet certain regulations. Phosphorus-free (also referred to as "free of phosphorous") means a concentrated composition having less than approximately 0.5 wt %, more particularly, less than approximately 0.1 wt %, and even more particularly less than approximately 0.01 wt % phosphorous based on the total weight of the concentrated composition. NTA-free (also referred to as "free of NTA") means a concentrated composition having less than approximately 0.5 wt %, less than approximately 0.1 wt %, and often less than approximately 0.01 wt % NTA based on the total weight of the concentrated composition.

Source of Acidity

The compositions of the invention can also be acidic in nature and can comprise at least one inorganic and/or organic acid in a sufficient amount in order that the compositions of the invention have a pH of 4 or less. Generally, useful inorganic acids include water soluble inorganic and mineral acids. Non-limiting examples of useful acids include hydrochloric acid, phosphoric acid, sulfuric acid, and so forth individually or in combination.

As for organic acids, non-limiting examples include any known organic acid which may be found effective in the inventive compositions. Generally useful organic acids are those which include at least one carbon atom, and include at least one carboxyl group (—COOH) in its structure. More specifically, useful organic acids contain from 1 to about 6 carbon atoms, have at least one carboxyl group, and are water soluble. Non-limiting examples include acetic acid, chloroacetic acid, citric acid, formic acid, propionic acid, and so forth.

Additional Functional Materials

The components of the surfactant booster or cleaning composition can be combined with various additional functional components. In some embodiments, the cleaning composition including the alkalinity source, acidity source, the surfactant system of the invention, and water make up a large amount, or even substantially all of the total weight of the cleaning composition, for example, in embodiments having few or no additional functional materials disposed therein. In these embodiments, the component concentrations ranges provided above for the cleaning composition are representative of the ranges of those same components in the cleaning composition.

The functional materials provide desired properties and functionalities to the detergent composition. For the purpose of this application, the term "functional materials" includes a material that when dispersed or dissolved in a use and/or concentrate, such as an aqueous solution, provides a beneficial property in a particular use. Some particular examples of functional materials are discussed in more detail below, although the particular materials discussed are given by way of example only, and that a broad variety of other functional materials may be used. For example, many of the functional materials discussed below relate to materials used in cleaning applications. However, other embodiments may include functional materials for use in other applications.

Additional Surfactants

The cleaning composition can contain an additional surfactant component that includes a detersive amount of an anionic surfactant or a mixture of anionic surfactants. Anionic surfactants are desirable in cleaning compositions because of their wetting, detersive properties, and often times good compatibility with membranes. The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the cleaning composition can have an alkyl group that contains 6 to 24 carbon atoms and the aryl group can be at least one of benzene, toluene, and xylene. A suitable alkyl aryl sulfonate includes linear alkyl benzene sulfonate. A suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. A suitable secondary alkane sulfonate includes sodium $C_{14}$-$C_{17}$ secondary alkyl sulfonate commercially available as Hostapur SAS from Clariant.

Suitable alkyl methyl ester sulfonates that can be used in the cleaning composition include those having an alkyl group containing 6 to 24 carbon atoms. Suitable alpha olefin sulfonates that can be used in the cleaning composition include those having alpha olefin groups containing 6 to 24 carbon atoms.

Suitable alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. A suitable alkoxy group is ethoxy. A suitable alkyl ether sulfate is sodium lauryl ether ethoxylate sulfate and is available under the name Steol CS-460.

Suitable alkyl sulfates that can be used in the cleaning composition include those having an alkyl group containing 6 to 24 carbon atoms. Suitable alkyl sulfates include, but are not limited to, sodium lauryl sulfate and sodium lauryl/myristyl sulfate.

Suitable alcohol sulfates that can be used in the cleaning composition include those having an alcohol group containing about 6 to about 24 carbon atoms.

In a preferred embodiment, the co-surfactant component is a smaller chain material, preferably less than 12 carbons and most preferably from about 6 to about 10 carbons. The surfactant of the invention and any optional co-surfactant combination together replace NPE on a 1:1 basis at the actives level.

The anionic surfactant can be neutralized with an alkaline metal salt, an amine, or a mixture thereof. Suitable alkaline metal salts include sodium, potassium, and magnesium. Suitable amines include monoethanolamine, triethanolamine, and monoisopropanolamine. If a mixture of salts is used, a suitable mixture of alkaline metal salt can be sodium and magnesium, and the molar ratio of sodium to magnesium can be between about 3:1 and about 1:1.

The cleaning composition, when provided as a concentrate, can include the surfactant component in an amount sufficient to provide a use composition having desired wetting and detersive properties after dilution with water. The concentrate can contain about 0.1 wt. % to about 0.5 wt. %, about 0.1 wt. % to about 1.0 wt. %, about 1.0 wt. % to about 5 wt. %, about 5 wt. % to about 10 wt. %, about 10 wt. % to about 20 wt. %, 30 wt. %, about 0.5 wt. % to about 25 wt. %, and about 1 wt. % to about 15 wt. %, and similar intermediate concentrations of the anionic surfactant.

The cleaning composition can contain an additional nonionic cosurfactant component that includes a detersive amount of an additional nonionic surfactant or a mixture of nonionic surfactants. Nonionic surfactants can be included in the cleaning composition to enhance grease removal properties. Although the additional cosurfactant component can include a nonionic surfactant component, it should be understood that the nonionic cosurfactant component can be excluded from the cleaning composition.

Nonionic surfactants that can be used in the composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants.

Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt. %.

Additional nonionic surfactants include alcohol alkoxylates. An suitable alcohol alkoxylate include linear alcohol ethoxylates such as Tornadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauramide diethanolamide, cocoamide diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl glucosides, or mixtures thereof.

When nonionic surfactants are included in the cleaning composition concentrate, they can be included in an amount of at least about 0.1 wt. % and can be included in an amount of up to about 15 wt. %. The concentrate can include about 0.1 to 1.0 wt. %, about 0.5 wt. % to about 12 wt. % or about 2 wt. % to about 10 wt. % of the nonionic surfactant.

Amphoteric surfactants can also be used to provide desired detersive properties. Suitable amphoteric surfactants that can be used include, but are not limited to: betaines, imidazolines, and propionates. Suitable amphoteric surfactants include, but are not limited to: sultaines, amphopropionates, amphodipropionates, aminopropionates, aminodipropionates, amphoacetates, amphodiacetates, and amphohydroxypropylsulfonates.

When the cleaning composition includes an amphoteric surfactant, the amphoteric surfactant can be included in an amount of about 0.1 wt. % to about 15 wt. %. The concentrate can include about 0.1 wt. % to about 1.0 wt. %, 0.5 wt. % to about 12 wt. % or about 2 wt. % to about 10 wt. % of the amphoteric surfactant.

Bleaching Agents

The cleaning composition may also include bleaching agents for lightening or whitening a substrate. Examples of suitable bleaching agents include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the present cleaning compositions include, for example, chlorine-containing compounds such as a chlorine, a hypochlorite, and chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosures of which are incorporated by reference herein for all purposes). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent. When the concentrate includes a bleaching agent, it can be included in an amount of about 0.1 wt. % to about 60 wt. %, about 1 wt. % to about 20 wt. %, about 3 wt. %) to about 8 wt. %, and about 3 wt. % to about 6 wt. %.

Cleaning Fillers

The cleaning composition can include an effective amount of cleaning fillers, which does not perform as a cleaning agent per se, but cooperates with the cleaning agent to enhance the overall cleaning capacity of the composition. Examples of cleaning fillers suitable for use in the present cleaning compositions include sodium sulfate, sodium chloride, starch, sugars, $C_1$-$C_{10}$ alkylene glycols such as propylene glycol, and the like. When the concentrate includes a cleaning filler, it can be included in an amount of between about 1 wt. %) and about 20 wt. % and between about 3 wt. % and about 15 wt. %.

Stabilizing Agents

Stabilizing agents that can be used in the cleaning composition include, but are not limited to: primary aliphatic amines, betaines, borate, calcium ions, sodium citrate, citric acid, sodium formate, glycerine, malonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to about 20 wt. %, between about 0.5 wt. % to about 15 wt. % and between about 2 wt. % to about 10 wt. %.

Dispersants

Dispersants that can be used in the cleaning composition include maleic acid/olefin copolymers, polyacrylic acid, and its copolymers, and mixtures thereof. The concentrate need not include a dispersant, but when a dispersant is included it can be included in an amount that provides the desired dispersant properties. Exemplary ranges of the dispersant in the concentrate can be up to about 20 wt. %, between about 0.5 w.% and about 15 wt. %, and between about 2 wt. % and about 9 wt. %.

Hydrotropes

The compositions of the invention may optionally include a hydrotrope that aides in compositional stability and aqueous formulation. Functionally speaking, the suitable hydrotrope couplers which can be employed are non-toxic and retain the active ingredients in aqueous solution throughout the temperature range and concentration to which a concentrate or any use solution is exposed.

Any hydrotrope coupler may be used provided it does not react with the other components of the composition or negatively affect the performance properties of the composition. Representative classes of hydrotropic coupling agents or solubilizers which can be employed include anionic surfactants such as alkyl sulfates and alkane sulfonates, linear alkyl benzene or naphthalene sulfonates, secondary alkane sulfonates, alkyl ether sulfates or sulfonates, alkyl phosphates or phosphonates, dialkyl sulfosuccinic acid esters, sugar esters (e.g., sorbitan esters), amine oxides (mono-, di-, or tri-alkyl)

and $C_8$-$C_{10}$ alkyl glucosides. Preferred coupling agents for use in the present invention include n-octanesulfonate, available as NAS 8D from Ecolab Inc., n-octyl dimethylamine oxide, and the commonly available aromatic sulfonates such as the alkyl benzene sulfonates (e.g. xylene sulfonates) or naphthalene sulfonates, aryl or alkaryl phosphate esters or their alkoxylated analogues having 1 to about 40 ethylene, propylene or butylene oxide units or mixtures thereof. Other preferred hydrotropes include nonionic surfactants of $C_6$-$C_{24}$ alcohol alkoxylates (alkoxylate means ethoxylates, propoxylates, butoxylates, and co-or-terpolymer mixtures thereof) (preferably $C_6$-$C_{14}$ alcohol alkoxylates) having 1 to about 15 alkylene oxide groups (preferably about 4 to about 10 alkylene oxide groups); $C_6$-$C_{24}$ alkylphenol alkoxylates (preferably $C_8$-$C_{10}$ alkylphenol alkoxylates) having 1 to about 15 alkylene oxide groups (preferably about 4 to about 10 alkylene oxide groups); $C_6$-$C_{24}$ alkylpolyglycosides (preferably $C_6$-$C_{20}$ alkylpolyglycosides) having 1 to about 15 glycoside groups (preferably about 4 to about 10 glycoside groups); $C_6$-$C_{24}$ fatty acid ester ethoxylates, propoxylates or glycerides; and $C_4$-$C_{12}$ mono or dialkanolamides. A preferred hydrotope is sodium cumenesulfonate (SCS).

The composition of an optional hydrotrope can be present in the range of from about 0 to about 25 percent by weight.

Water Conditioning Agent/Chelant

Water conditioning agents function to inactivate water hardness and prevent calcium and magnesium ions from interacting with soils, surfactants, carbonate and hydroxide. Water conditioning agents therefore improve detergency and prevent long term effects such as insoluble soil redepositions, mineral scales and mixtures thereof. Water conditioning can be achieved by different mechanisms including sequestration, precipitation, ion-exchange and dispersion (threshold effect).

The water conditioning agents which can be used include inorganic water soluble water conditioning agents, inorganic water insoluble water conditioning agents, organic water soluble conditioning agents, and organic water insoluble water conditioning agents. Exemplary inorganic water soluble water conditioning agents include all physical forms of alkali metal, ammonium and substituted ammonium salts of carbonate, bicarbonate and sesquicarbonate; pyrophosphates, and condensed polyphosphates such as tripolyphosphate, trimetaphosphate and ring open derivatives; and, glassy polymeric metaphosphates of general structure $M_n+2P_nO_3n+1$ having a degree of polymerization n of from about 6 to about 21 in anhydrous or hydrated forms; and, mixtures thereof. Exemplary inorganic water insoluble water conditioning agents include aluminosilicate builders. Exemplary water soluble water conditioning agents include aminpolyacetates, polyphosphonates, aminopolyphosphonates, short chain carboxylates and polycarboxylates. Organic water soluble water conditioning agents useful in the compositions of the present invention include aminpolyacetates, polyphosphonates, aminopolyphosphonates, short chain carboxylates and a wide variety of polycarboxylate compounds.

Aminopolyacetate water conditioning salts suitable for use herein include the sodium, potassium lithium, ammonium, and substituted ammonium salts of the following acids: ethylenediaminetetraacetic acid, N-(2-hydroxyethyl)-ethylenediamine triacetic acid, N-(2-hydroxyethyl)-nitrilodiacetic acid, diethylenetriaminepentaacetic acid, 1,2-diaminocyclohexanetetracetic acid and nitrilotriacetic acid; and, mixtures thereof. Polyphosphonates useful herein specifically include the sodium, lithium and potassium salts of ethylene diphosphonic acid; sodium, lithium and potassium salts of ethane-1-hydroxy-1,1-diphosphonic acid and sodium lithium, potassium, ammonium and substituted ammonium salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid propane-1,1,2,3-tetraphophonic acid and propane 1,2,2,3-tetraphosphonic acid; and mixtures thereof. Examples of these polyphosphonic compounds are disclosed in British Pat. No. 1,026,366. For more examples see U.S. Pat. No. 3,213,030 to Diehl issued Oct. 19, 1965 and U.S. Pat. No. 2,599,807 to Bersworth issued Jun. 10, 1952. Aminopolyphosphonate compounds are excellent water conditioning agents and may be advantageously used in the present invention. Suitable examples include soluble salts, e.g. sodium, lithium or potassium salts, of diethylene thiamine pentamethylene phosphonic acid, ethylene diamine tetramethylene phosphonic acid, hexamethylenediamine tetramethylene phosphonic acid, and nitrilotrimethylene phosphonic acid; and, mixtures thereof. Water soluble short chain carboxylic acid salts constitute another class of water conditioner for use herein. Examples include citric acid, gluconic acid and phytic acid. Preferred salts are prepared from alkali metal ions such as sodium, potassium, lithium and from ammonium and substituted ammonium. Suitable water soluble polycarboxylate water conditioners for this invention include the various ether polycarboxylates, polyacetal, polycarboxylates, epoxy polycarboxylates, and aliphatic-, cycloalkane- and aromatic polycarboxylates.

Enzymes

Enzymes can be used to catalyze and facilitate organic and inorganic reactions. It is well known, for example, that enzymes are used in metabolic reactions occurring in animal and plant life.

The enzymes that can be used according to the invention include simple proteins or conjugated proteins produced by living organisms and functioning as biochemical catalysts which, in cleaning technology, degrade or alter one or more types of soil residues encountered on food process equipment surfaces thus removing the soil or making the soil more removable by the cleaning-cleaning system. Both degradation and alteration of soil residues improve detergency by reducing the physicochemical forces which bind the soil to the surface being cleaned, i.e. the soil becomes more water soluble. The enzyme may be functional in either the acidic, neutral or alkaline pH range.

As defined in the art, enzymes are referred to as simple proteins when they require only their protein structures for catalytic activity. Enzymes are described as conjugated proteins if they require a non-protein component for activity, termed co factor, which is a metal or an organic biomolecule often referred to as a coenzyme. Cofactors are not involved in the catalytic events of enzyme function. Rather, their role seems to be one of maintaining the enzyme in an active configuration. As used herein, enzyme activity refers to the ability of an enzyme to perform the desired catalytic function of soil degradation or alteration; and, enzyme stability pertains to the ability of an enzyme to remain or to be maintained in the active state.

Enzymes are extremely effective catalysts. In practice, very small amounts will accelerate the rate of soil degradation and soil alteration reactions without themselves being consumed in the process. Enzymes also have substrate (soil) specificity which determines the breadth of its catalytic effect. Some enzymes interact with only one specific substrate molecule (absolute specificity); whereas, other enzymes have broad specificity and catalyze reactions on a family of structurally similar molecules (group specificity).

Enzymes exhibit catalytic activity by virtue of three general characteristics: the formation of a noncovalent complex with the substrate, substrate specificity, and catalytic rate. Many compounds may bind to an enzyme, but only certain types will lead to subsequent reaction. The latter are called substrates and satisfy the particular enzyme specificity requirement. Materials that bind but do not thereupon chemically react can affect the enzymatic reaction either in a positive or negative way. For example, unreacted species called inhibitors interrupt enzymatic activity.

Several enzymes may fit into more than one class. A valuable reference on enzymes is "Industrial Enzymes", Scott, D., in Kirk-Othmer Encyclopedia of Chemical Technology, 3rd Edition, (editors Grayson, M. and EcKroth, D.) Vol. 9, pp. 173-224, John Wiley & Sons, New York, 1980. The disclosure of this reference relating to enzymes is incorporated herein by reference.

Proteases, a sub-class of hydrolases, are further divided into three distinct subgroups which are grouped by the pH optima (i.e. optimum enzyme activity over a certain pH range). These three subgroups are the alkaline, neutral and acids proteases. These proteases can be derived from vegetable, animal or microorganism origin; but, preferably are of the latter origin which includes yeasts, molds and bacteria. Examples of suitable commercially available alkaline proteases are Alcalase®, Savinase®, and Esperase®-all of Novo Industri AS, Denmark; Purafect® of Genencor International; Maxacal®, Maxapem® and Maxatase®-all of Gist-Brocase International NV, Netherlands; Optimase® and Opticlean® of Solvay Enzymes, USA and so on.

Commercial alkaline proteases are obtainable in liquid or dried form, are sold as raw aqueous solutions or in assorted purified, processed and compounded forms, and are comprised of about 2% to about 80% by weight active enzyme generally in combination with stabilizers, buffers, cofactors, impurities and inert vehicles. The actual active enzyme content depends upon the method of manufacture and is not critical, assuming the cleaning solution has the desired enzymatic activity. The particular enzyme chosen for use in the process and products of this invention depends upon the conditions of final utility, including the physical product form, use pH, use temperature, and soil types to be degraded or altered. The enzyme can be chosen to provide optimum activity and stability for any given set of utility conditions.

Naturally, mixtures of different proteolytic enzymes may be used. While various specific enzymes have been described above, it is to be understood that any protease which can confer the desired proteolytic activity to the composition may be used and this embodiment of this invention is not limited in any way by specific choice of proteolytic enzyme.

In addition to proteases, it is also to be understood, and one skilled in the art will see from the above enumeration, that other enzymes which are well known in the art may also be used with the composition of the invention. Included are other hydrolases such as esterases, carboxylases and the like; and, other enzyme classes.

Further, in order to enhance its stability, the enzyme or enzyme admixture may be incorporated into various non-liquid embodiments of the present invention as a coated, encapsulated, agglomerated, prilled or marumerized form. Also, to enhance stability, the enzyme or enzyme admixture may be incorporated into various non-aqueous embodiments such as propylene glycol, glycerin, etc.

pH Adjusting Agents

Various pH adjusting agents can be utilized to alter the pH of the treatment composition. The pH adjusting agents can provide desired buffering systems. Exemplary alkaline pH adjusting agents include carbonate, bicarbonate, sodium hydroxide, tetraborate, and boric acid. A buffering system that includes carbonate and bicarbonate can provide an exemplary pH of between about 9 and about 10, a buffering system that includes carbonate and sodium hydroxide can provide an exemplary pH of between about 9 and about 11, and a buffering system that includes sodium tetraborate and boric acid can include a pH of between about 7.6 and about 9.2. The pH adjusting agent can include an acid to provide an acidic buffering system. Exemplary acids include citric acid, citrate, acetic acid, acetate, phosphoric acid, and phosphate. For example, a buffering system including citric acid and sodium hydroxide can provide an exemplary pH of between about 2.2 and about 6.5, a buffering system that includes sodium citrate and citric acid can provide an exemplary pH of between about 3.0 and about 6.2, a buffering system that includes sodium acetate and acetic acid can provide an exemplary pH of between about 3.6 and about 5.6, and a buffering system that includes sodium dihydrogen phosphate and disodium hydrogen phosphate can provide an exemplary pH of between about 5.8 and about 8.0.

Clean in Place

The membrane cleaning compositions and methods of the invention are generally clean-in-place systems (CIP), clean-out-of-place systems (COP), textile laundry machines, micro, ultra, nano and reverse osmosis filtration systems. COP systems can include readily accessible systems including wash tanks, soaking vessels, mop buckets, holding tanks, scrub sinks, vehicle parts washers, non-continuous batch washers and systems, and the like. CIP systems include the internal components of tanks, lines, pumps and other process equipment used for processing typically liquid product streams such as beverages, milk, and juices.

Generally, the cleaning of the in-place system or other surface (i.e., removal of unwanted offal therein) is accomplished with an alkaline cleaning which is introduced with heated water. The compositions of the invention may be introduced during, prior to, or concurrently with the cleaning step (as a separate booster or as part of the cleaning composition) and are applied or introduced into the system at a use solution concentration in unheated, ambient temperature water. CIP typically employ flow rates on the order of about 40 to about 600 liters per minute, temperatures from ambient up to about 70° C., and contact times of at least about 10 seconds, for example, about 30 to about 120 seconds. The present composition can remain in solution in cold (e.g., 40° F./4° C.) water and heated (e.g., 140° F./60° C.) water. Although it is not normally necessary to heat the aqueous use solution of the present composition, under some circumstances heating may be desirable to further enhance its activity. These materials are useful at any conceivable temperatures.

Membrane Treating Programs

Various different treatment programs can be used to treat a membrane according to the invention. The method for treating a membrane can include a plurality of steps. A first step can be referred to as a product removal step or displacement where product (whey, milk, etc.) is removed from the filtration system. The product can be effectively recovered and used as opposed to discharging as plant effluent. In general, the product removal step can be characterized as an exchange step where water, gas, or multiple phase flow displaces the product from the membrane system. The product removal step can last as long as it takes to remove and recover product from the filtration system. In general, it is expected that the product removal step will take at least a couple minutes for most dairy filtration systems.

Another step often used can be referred to as a pre-rinse step. In general, water and/or an alkaline solution can be circulated in the filtration system to remove gross soils. It should be understood that a large scale filtration system refers to an industrial system having at least about 10 membrane vessels, at least about 40 membranes, and a total membrane area of at least about 200 $m^2$. Industrial filtration systems for use in dairy and brewery applications often include about 10 to about 200 membrane vessels, about 40 to about 1,000 membranes, and a total membrane area of about 200 $m^2$ to about 10,000 $m^2$.

Several chemistry treatment cycles can be repeated for acid treatment, alkaline treatment, and neutral treatment. In general, the various treatments can be provided with or without an enzyme.

The liquid component can be provided as an alkaline treatment, an acidic treatment, a neutral treatment, a solvent treatment and/or as an enzymatic treatment.

By way of example, the surfactant system of the invention can be used in various steps in the filter cleaning process. For example, rinsing can be accomplished with the surfactant composition of the invention alone or as a neutral, acidic, or alkaline solution. Cleaning can be accomplished using a cleaning composition that can include alkaline, acid, enzymes, non-aqueous components, and/or the surfactant composition of the invention. Sanitizing and/or preserving can be accomplished with a composition that includes chlorine, acids, peracids, and/or reducing compositions. A penetrant is generally considered to be a component that penetrates into the soil and softens the soil for removal. The penetrant can be selected for the particular type of soil expected on the membrane. In the case of membranes used in the dairy industry, it is expected that the penetrant will be selected to provide for penetration into protein and lipid soils.

Forming a Concentrate

The concentrate composition of the present invention can be provided as a solid, liquid, or gel, or a combination thereof. In one embodiment, the cleaning compositions may be provided as a concentrate such that the cleaning composition is substantially free of any added water or the concentrate may contain a nominal amount of water. The concentrate can be formulated without any water or can be provided with a relatively small amount of water in order to reduce the expense of transporting the concentrate. For example, the composition concentrate can be provided as a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the composition concentrate with the water. For the purposes of this disclosure, the terms "capsule" and "pellet" are used for exemplary purposes and are not intended to limit the delivery mode of the invention to a particular shape.

When provided as a liquid concentrate composition, the concentrate can be diluted through dispensing equipment using aspirators, peristaltic pumps, gear pumps, mass flow meters, and the like. This liquid concentrate embodiment can also be delivered in bottles, jars, dosing bottles, bottles with dosing caps, and the like. The liquid concentrate composition can be filled into a multi-chambered cartridge insert that is then placed in a spray bottle or other delivery device filled with a pre-measured amount of water.

In yet another embodiment, the concentrate composition can be provided in a solid form that resists crumbling or other degradation until placed into a container. Such container may either be filled with water before placing the composition concentrate into the container, or it may be filled with water after the composition concentrate is placed into the container. In either case, the solid concentrate composition dissolves, solubilizes, or otherwise disintegrates upon contact with water. In a particular embodiment, the solid concentrate composition dissolves rapidly thereby allowing the concentrate composition to become a use composition and further allowing the end user to apply the use composition to a surface in need of cleaning. When the cleaning composition is provided as a solid, the compositions provided above may be altered in a manner to solidify the cleaning composition by any means known in the art. For example, the amount of water may be reduced or additional ingredients may be added to the cleaning composition, such as a solidification agent.

In another embodiment, the solid concentrate composition can be diluted through dispensing equipment whereby water is sprayed at the solid block forming the use solution. The water flow is delivered at a relatively constant rate using mechanical, electrical, or hydraulic controls and the like. The solid concentrate composition can also be diluted through dispensing equipment whereby water flows around the solid block, creating a use solution as the solid concentrate dissolves. The solid concentrate composition can also be diluted through pellet, tablet, powder and paste dispensers, and the like.

The water used to dilute the concentrate (water of dilution) can be available at the locale or site of dilution. The water of dilution may contain varying levels of hardness depending upon the locale. Service water available from various municipalities have varying levels of hardness. It is desirable to provide a concentrate that can handle the hardness levels found in the service water of various municipalities. The water of dilution that is used to dilute the concentrate can be characterized as hard water when it includes at least 1 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. If the use solution is required to remove tough or heavy soils, it is expected that the concentrate can be diluted with the water of dilution at a weight ratio of at least 1:1 and up to 1:8. If a light duty cleaning use solution is desired, it is expected that the concentrate can be diluted at a weight ratio of concentrate to water of dilution of up to about 1:256.

In an alternate embodiment, the cleaning compositions may be provided as a ready-to-use (RTU) composition. If the cleaning composition is provided as a RTU composition, a more significant amount of water is added to the cleaning composition as a diluent. When the concentrate is provided as a liquid, it may be desirable to provide it in a flowable form so that it can be pumped or aspirated. It has been found that it is generally difficult to accurately pump a small amount of a liquid. It is generally more effective to pump a larger amount of a liquid. Accordingly, although it is desirable to provide the concentrate with as little water as possible in order to reduce transportation costs, it is also desirable to provide a concentrate that can be dispensed accurately. In the case of a liquid concentrate, it is expected that water will be present in an amount of up to about 90 wt. %, particularly between about 20 wt. % and about 85 wt. %, more particularly between about 30 wt. % and about 80 wt. %) and most particularly between about 50 wt. % and about 80 wt. %.

In the case of a RTU composition, it should be noted that the above-disclosed cleaning composition may, if desired, be further diluted with up to about 96 wt. % water, based on the weight of the cleaning composition.

The cleaning composition may be made using a mixing process. The surfactant booster composition and/or cleaning composition comprising the same and other functional ingredients are mixed for an amount of time sufficient to form a final, homogeneous composition. In an exemplary embodiment, the components of the cleaning composition are mixed for approximately 10 minutes.

A solid cleaning composition as used in the present disclosure encompasses a variety of forms including, for example, solids, pellets, blocks, tablets, and powders. By way of example, pellets can have diameters of between about 1 mm and about 10 mm, tablets can have diameters of between about 1 mm and about 10 mm or between about 1 cm and about 10 cm, and blocks can have diameters of at least about 10 cm. It should be understood that the term "solid" refers to the state of the cleaning composition under the expected conditions of storage and use of the solid cleaning composition. In general, it is expected that the cleaning composition will remain a solid when provided at a temperature of up to about 100° F. or lower than about 120° F.

In certain embodiments, the solid cleaning composition is provided in the form of a unit dose. A unit dose refers to a solid cleaning composition unit sized so that the entire unit is used during a single cycle. When the solid cleaning composition is provided as a unit dose, it can have a mass of about 1 g to about 50 g. In other embodiments, the composition can be a solid, a pellet, or a tablet having a size of about 50 g to 250 g, of about 100 g or greater, or about 40 g to about 11,000 g.

In other embodiments, the solid cleaning composition is provided in the form of a multiple-use solid, such as, a block or a plurality of pellets, and can be repeatedly used to generate aqueous cleaning compositions for multiple washing cycles. In certain embodiments, the solid cleaning composition is provided as a solid having a mass of about 5 g to about 10 kg. In certain embodiments, a multiple-use form of the solid cleaning composition has a mass of about 1 to about 10 kg. In further embodiments, a multiple-use form of the solid cleaning composition has a mass of about 5 kg to about 8 kg. In other embodiments, a multiple-use form of the solid cleaning composition has a mass of about 5 g to about 1 kg, or about 5 g and to about 500 g.

The components can be mixed and extruded or cast to form a solid such as pellets, powders or blocks. Heat can be applied from an external source to facilitate processing of the mixture.

A mixing system provides for continuous mixing of the ingredients at high shear to form a substantially homogeneous liquid or semi-solid mixture in which the ingredients are distributed throughout its mass. The mixing system includes means for mixing the ingredients to provide shear effective for maintaining the mixture at a flowable consistency, with a viscosity during processing of about 1,000-1,000,000 cP, preferably about 50,000-200,000 cP. The mixing system can be a continuous flow mixer or a single or twin screw extruder apparatus.

The mixture can be processed at a temperature to maintain the physical and chemical stability of the ingredients, such as at ambient temperatures of about 20-80° C., and about 25-55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the scale control component may be separate from the remainder of the cleaning composition. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate can be divided into useful sizes with a controlled mass. The extruded solid can be packaged in film. The temperature of the mixture when discharged from the mixing system can be sufficiently low to enable the mixture to be cast or extruded directly into a packaging system without first cooling the mixture. The time between extrusion discharge and packaging can be adjusted to allow the hardening of the cleaning block for better handling during further processing and packaging. The mixture at the point of discharge can be about 20-90° C., and about 25-55° C. The composition can be allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20-90° C.

When processing of the ingredients is completed, the mixture may be discharged from the mixer through a discharge die. The solidification process may last from a few minutes to about six hours, depending, for example, on the size of the cast or extruded composition, the ingredients of the composition, the temperature of the composition, and other like factors. Preferably, the cast or extruded composition "sets up" or begins to harden to a solid form within about 1 minute to about 3 hours, preferably about 1 minute to about 2 hours, most preferably about 1 minute to about 1.0 hours minutes.

The concentrate can be provided in the form of a liquid. Various liquid forms include gels and pastes. Of course, when the concentrate is provided in the form of a liquid, it is not necessary to harden the composition to form a solid. In fact, it is expected that the amount of water in the composition will be sufficient to preclude solidification. In addition, dispersants and other components can be incorporated into the concentrate in order to maintain a desired distribution of components.

In certain embodiments, the cleaning composition may be mixed with a water source prior to or at the point of use. In other embodiments, the cleaning compositions do not require the formation of a use solution and/or further dilution and may be used without further dilution.

In aspects of the invention employing solid cleaning compositions, a water source contacts the cleaning composition to convert solid cleaning compositions, particularly powders, into use solutions. Additional dispensing systems may also be utilized which are more suited for converting alternative solid cleanings compositions into use solutions. The methods of the present invention include use of a variety of solid cleaning compositions, including, for example, extruded blocks or "capsule" types of package.

In an aspect, a dispenser may be employed to spray water (e.g. in a spray pattern from a nozzle) to form a cleaning use solution. For example, water may be sprayed toward an apparatus or other holding reservoir with the cleaning composition, wherein the water reacts with the solid cleaning composition to form the use solution. In certain embodiments of the methods of the invention, a use solution may be configured to drip downwardly due to gravity until the dissolved solution of the cleaning composition is dispensed for use according to the invention. In an aspect, the use solution may be dispensed into a wash solution of a ware wash machine.

EXAMPLES

Purpose/Background

The intent of this invention was to find a suitable replacement for the surfactant nonylphenol ethoxylate (NPE 9.5) and tridecyl alcohol ethoxylate (TDA-9), also known as Ultrasil 01 (U01) and Ultrasil 06 (U06), respectively. The surfactants and polymers are used as a membrane cleaning adjuvant for improved removal of high fat, protein, and other soils and in some cases improving the wetting-out or permeation properties. Other considerations for a successful replacement chemistry are good rinsing characteristics, low foaming, good stainless steel cleaning properties, and relatively low cost.

This change is required due to environmental concerns from the Environmental Protection Agency (EPA) over the use of alkyl phenol ethoxylates (APEs). TDA-9 (U06) was an attempt at replacing NPE 9.5 (U01) in the Ultrasil product line for cleaning process membrane systems, but growing customer concerns and supporting data suggested some negative effects on membrane performance when replacing NPE 9.5 with TDA-9. Initial issues were confined to ultrafiltration (UF) brine systems utilizing polyvinylidene fluoride (PVDF) membranes, but more recent issues also point to problems with a milk and whey UF systems utilizing polyethersulfone (PES) membranes. The issues are related to how the membrane performs or fluxes during production after being cleaned with a particular surfactant. Production performance after a particular cleaning sequence likely has to do with the cleanliness of the membrane, the amount of cleaner components that foul the membrane due to poor rinsing, surface modification of the membrane to achieve more hydrophilic surface which reduces attraction of hydrophobic soils.

Procedure:

Membrane Performance and Rinsing

Surfactant candidates for replacement of NPE 9.5 were evaluated in the following categories: Membrane Production Performance, Rinsing Characteristics, Foaming, Cleaning, and Cost. A flat membrane sheet tester was used to evaluate surfactants and polymers and to document the interaction with various membrane types. Initially, all surfactant concentrations were tested at 0.6% w/w of active surfactant. This concentration is typically the high-end of recommendations utilized in field applications and was used to create worst case scenario for rinsing surfactant from membrane.

The following information compares the rinsing and production data of the flat sheet equipment to an example production membrane system. As the data indicates, it is difficult to minimize the water rinse volume per membrane area to equate to the rinse volume per membrane area of a production system due to the differences in the equipment setup, membrane area, and associated hold-up volumes. This is why the protocol calls for short rinse cycles at times to ensure the effect of the surfactant solution on the membrane performance is evaluated properly.

Flat Sheet Testing Apparatus Information:

- Each membrane sheet=0.018 m
- Area per permeate plate (must have two membrane sheets)= 0.036 m
- Rinse Volume (Min Rinse) 3 min 4 Hz pump speed=2.5 L=69 L/m=18.3 gal/$m^2$
- Rinse Volume (Max Rinse) 10 min 9-10 Hz pump speed=13.0 L=361 L/m=95.4 gal/$m^2$ Example Production System

- 3.8" element=7.2 $m^2$
- 100 elements=720 $m^2$
- CIP Holdup Vol=300 gal
- 3× Rinse holdup Vol=900 gal
- Rinse Estimate per Memb Area=1.25 gal/$m^2$=4.7 L/$m^2$ Membrane Production Performance testing was performed on a flat sheet membrane apparatus at 80 F, pump speed of 18 Hz, 40 psig in, 30 psig out. The steps for testing are outlined in Table 1. The first step is to wash or condition the membrane with Ultrasil 110 that does not contain any surfactant at a pH of 11.0-11.1 for a period of 10 minutes at the conditions listed in the table. Following the alkaline wash conditioning step is the DI water rinse step, followed by a clean water flux (CWF) reading. The CWF reading is important at this step to ensure the membrane is not fouled from previous tests and is fluxing within the specifications for the particular membrane. Usually there is a +/−20% range for CWFs according to manufacturer's specifications. For this protocol, the CWF was expected to be +/−10% in order to conclude surfactant or polymer was adequately rinsed and was not fouling the membrane. The next step involves treating the membrane with a 0.6% w/w active surfactant solution at 18 Hz, 118 F, 25 psig in, 15 psig out and pH of 11.0-11.1 using Ultrasil 110 (no surfactant). This alkaline/surfactant solution is allowed to circulate at the above set conditions for 20 minutes and flux is measured at 10 and 20 minutes. The flux measurements is for two purposes, the first being to ensure that the membranes are adequately conditioned with the surfactant being tested, and secondly, to measure the initial and delayed effects on flux due to the addition of the surfactant to the system. The surfactant solution is then rinsed with 2.5 L of DI water at a pump speed 4 Hz to eliminate alkalinity in the system and to reach the conductivity of DI water. With 2.5 L of DI water there is likely residual surfactant in the system which is what has been found in field samples. After the surfactant treatment and rinsing, two gallons of 2% milk are added to the system and allowed to circulate for at least 5-10 minutes at the set conditions. This step is to ensure a more comprehensive study on how the membranes perform under simulated production conditions. The milk is then concentrated until a concentration factor (CF) of 2.00 is reached. Flux measurements are taken at CF=1.00, 1.07, 1.15, 1.36, 1.66, and 2.00. We believe reaching a CF of 2.00 provides enough meaningful data regarding the surfactant treatment in the shortest amount of time. After the milk production run concludes, a "dirty flux" is measured using DI water under the conditions listed in the table. Additional alkaline stripping and DI rinse steps are repeated again as followed at the top of Table 1. This consists of alkaline Ultrasil 110 (no surfactant) "stripping" cycles until a baseline clean water flux (CWF) of 275 LMH+/−10% is reached. As previously noted, the purpose of this step is to make sure that as much fat soil and residual surfactant is removed from the membranes as possible and to ensure that the following surfactant being tested is not interacting with previous surfactants in an unaccounted way. If CWF of 275 LMH+/−10% is not reached, another cycle of alkaline "stripping" and DI rinsing is conducted until baseline is reached. To review, here are the steps in tabular format.

TABLE 1

Membrane Production Wash Protocol

| Step | Description | Duration | Pump Speed (Hz) | Temp. (F.) | Psig in | Psig out | pH |
|---|---|---|---|---|---|---|---|
| 1 | Alkaline Wash - U110 (No surfactant) | 10 minutes | 18 | 118 | 25 | 15 | 11.0-11.1 |
| 2 | DI Water Rinse | 13 L | 10 | — | — | — | — |
| 3 | CWF (DI) | 10 minutes | 18 | 80 | 25 | 15 | — |
| 4 | CWF must reach 275 LMH +/−10% for both membranes, otherwise repeat steps 1-3 until baseline is reached | | | | | | |
| 5 | Alkaline Wash - U110 (No surfactant) | 10 minutes | 18 | 118 | 25 | 15 | 11.0-11.1 |
| 6 | 0.6% w/w active Surfactant + Alkaline using U110 (no surfactant) | 20 minutes, measure flux at 10 and 20 minutes | 18 | 118 | 25 | 15 | 11.0-11.1 |
| 7 | DI Water Rinse | 2.5 L | 4 | — | — | — | — |
| 8 | Milk Circulation | 5-10 minutes | 18 | 80 | 45 | 15 | — |
| 9 | Milk Concentration | Until CF = 2 is reached | 18 | 80 | 45 | 15 | — |
| 10 | DI Product Displacement | Run until clear (~45 sec) | 10 | Ambient | Open Con. Valve | | |
| 11 | Dirty Flux with DI Water Closed Loop | 1 minute | 18 | Ambient | 25 | 15 | — |
| 12 | Repeat Steps 1-11 | | | | | | |

Membrane Performance and Rinsing Results

Tables 2 and 3 show some of the chemistries tested for membrane production throughput for both PES and PVDF membranes, respectively, ranked according to highest average flux during simulated production. Flux measurements are taken at CF=1.00, 1.07, 1.15, 1.36, 1.66, and 2.00. CF=1.5 in the table signifies average between the CF 1.36 and CF 1.66 flux measurements during simulated production. AVG signifies the average flux over the course of all six flux measurements during simulated production. Flux values are depicted in liter per membrane area in square meters per hour (LMH). Note that surfactants and abbreviations are listed in greater detail in Table 4.

TABLE 2

PES Membrane Milk Concentration Performance

| Membrane Type: PES SURFACTANT | CF = 1.0 LMH | CF = 1.5 LMH | CF = 2.0 LMH | AVG LMH |
|---|---|---|---|---|
| PEG 1450/Alkyl C6 Glycoside Blend (50/50) | 39.2 | 32.1 | 29.2 | 32.8 |
| Alkyl C6 Glycoside | 37.5 | 30.8 | 27.9 | 31.7 |
| U110 + No LAS + Cl2 150 ppm | 37.5 | 28.8 | 26.7 | 30.5 |
| PEG 1450 | 38.3 | 28.8 | 26.7 | 30.5 |
| LAEO C9-11, 6EO | 39.2 | 28.8 | 25.8 | 30.3 |
| Guerbet XP-50 | 37.5 | 29.6 | 26.3 | 30.3 |
| PEG 4000 | 35.4 | 29.2 | 25.8 | 29.5 |
| PCA—Polycarboxylated Alcohol | 38.3 | 28.5 | 24.2 | 29.5 |
| Guerbet XP-40 | 38.3 | 28.1 | 24.6 | 29.5 |
| PEG 1450/Guerbet XP-50 Blend (50/50) | 40.0 | 27.9 | 24.2 | 29.4 |
| PEG 1450/Alkyl C6 Glucoside w/ U110 (50/50) | 36.7 | 28.3 | 25.8 | 29.4 |
| APG/Guerbet XP-50 Blend (50/50) | 38.8 | 27.7 | 25.0 | 29.4 |
| Guerbet XP-80 | 38.3 | 27.1 | 25.0 | 28.9 |
| PEG 1450/LAEO 91-6 Blend (50/50) | 38.3 | 27.1 | 24.2 | 28.8 |
| Guerbet XL-70 | 37.5 | 26.5 | 25.0 | 28.8 |
| LAEO C9-11, 8EO/6EO Blend (50/50) | 39.6 | 26.3 | 25.0 | 28.7 |
| PEG 300 | 38.3 | 26.3 | 25.0 | 28.6 |
| U110 + No LAS (test to 300LMH) | 37.9 | 25.8 | 24.2 | 28.0 |
| U01 (100% NPE-9.5) Test 2 | 37.5 | 26.7 | 22.9 | 28.0 |
| U01 (NPE-9.5) | 39.2 | 28.3 | 24.6 | 28.0 |
| PEG 1450/Alkyl C6 Glucoside/Guerbet XP-50 (40/40/20) | 35.8 | 27.3 | 23.3 | 28.0 |
| LAS | 35.0 | 26.9 | 23.8 | 27.9 |
| LAEO C9-11, 8EO | 35.4 | 26.7 | 24.2 | 27.8 |
| Polysorbate 20 | 36.7 | 26.3 | 22.5 | 27.6 |

TABLE 2-continued

| PES Membrane Milk Concentration Performance | | | | |
|---|---|---|---|---|
| Membrane Type: PES SURFACTANT | CF = 1.0 LMH | CF = 1.5 LMH | CF = 2.0 LMH | AVG LMH |
| Guerbet XL-50 | 38.3 | 25.2 | 21.7 | 27.4 |
| APG | 35.8 | 25.8 | 22.9 | 27.3 |
| LAEO 91-6/Alkyl C6 Glycoside Blend (50/50) | 37.9 | 25.0 | 21.7 | 27.2 |
| DOSS—Dioctyl sulfosuccinate | 36.7 | 25.8 | 22.9 | 27.2 |
| LAEO C12-15, 7EO | 35.8 | 25.6 | 20.8 | 26.9 |
| LAEO 91-6/Guerbet XP-50 Blend (50/50) | 36.7 | 25.4 | 21.7 | 26.9 |
| AOS (α-olefin sulfonate) | 35.0 | 24.6 | 22.5 | 26.4 |
| U02 (AO, AOS) | 37.5 | 25.2 | 19.2 | 26.3 |
| U06 (30% TDA-9) Test 2 | 36.7 | 24.0 | 20.0 | 25.6 |
| U06 (TDA-9) | 35.0 | 22.5 | 18.3 | 24.0 |

TABLE 3

| PVDF Membrane Milk Production Performance | | | | |
|---|---|---|---|---|
| Membrane Type: PVDF SURFACTANT | CF = 1.0 LMH | CF = 1.5 LMH | CF = 2.0 LMH | AVG LMH |
| PEG 1450 | 45.0 | 39.8 | 34.6 | 39.9 |
| LAEO C9-11, 6EO | 45.8 | 39.4 | 35.0 | 39.7 |
| PEG 1450/Alkyl C6 Glucoside Blend (50/50) | 45.0 | 40.0 | 33.8 | 39.5 |
| Guerbet XP-50 | 46.7 | 39.2 | 34.2 | 39.4 |
| PCA—Polycarboxylated Alcohol | 46.7 | 38.8 | 33.8 | 39.1 |
| Guerbet XL-70 | 46.7 | 38.5 | 34.2 | 39.0 |
| APG/Guerbet XP-50 Blend (50/50) | 45.8 | 38.3 | 33.3 | 38.9 |
| Alkyl C6 Glucoside | 45.0 | 39.0 | 34.2 | 38.8 |
| PEG 1450/Guerbet XP-50 Blend (50/50) | 45.0 | 39.2 | 33.3 | 38.8 |
| PEG 1450/Alkyl C6 Glucoside w/ U110 (50/50) | 43.3 | 39.0 | 34.2 | 38.7 |
| Guerbet XP-80 | 45.0 | 38.3 | 34.2 | 38.6 |
| PEG 1450/LAEO 91-6 Blend (50/50) | 45.0 | 38.5 | 33.3 | 38.5 |
| Guerbet XP-40 | 45.8 | 37.9 | 32.5 | 38.1 |
| LAS | 39.6 | 37.9 | 33.8 | 38.1 |
| U01 (100% NPE-9.5) Test 2 | 45.0 | 37.5 | 32.5 | 38.0 |
| LAEO C9-11, 8EO | 40.8 | 37.5 | 33.8 | 37.2 |
| PEG 1450/Alkyl C6 Glycoside/Guerbet XP-50 (40/40/20) | 41.7 | 37.3 | 32.5 | 37.2 |
| LAEO 91-6/Guerbet XP-50 Blend (50/50) | 45.0 | 36.3 | 31.7 | 37.1 |
| PEG 4000 | 46.7 | 36.3 | 30.8 | 36.9 |
| LAEO 91-6/Alkyl C6 Glucoside Blend (50/50) | 43.3 | 36.9 | 30.8 | 36.7 |
| LAEO C9-11, 8EO/6EO Blend (50/50) | 44.2 | 35.4 | 32.5 | 36.7 |
| Guerbet XL-50 | 45.0 | 35.4 | 28.3 | 35.6 |
| U110 + No LAS + Cl2 | 41.7 | 34.2 | 30.8 | 35.1 |
| U01 (NPE-9.5) | 42.5 | 34.2 | 26.7 | 34.2 |
| APG | 40.0 | 33.3 | 30.0 | 34.0 |
| U06 (30% TDA-9) Test 2 | 41.7 | 32.9 | 27.5 | 33.6 |
| DOSS—Dioctyl sulfosuccinate | 41.7 | 32.1 | 27.5 | 33.1 |
| PEG 300 | 42.5 | 30.4 | 26.7 | 32.1 |
| U110 + No LAS (test to 300LMH) | 42.5 | 29.4 | 25.8 | 31.2 |
| AOS (α-olefin sulfonate) | 39.6 | 28.8 | 25.8 | 30.5 |
| LAEO C12-15, 7EO | 37.5 | 28.1 | 24.6 | 29.5 |
| U06 (TDA-9) | 40.0 | 28.5 | 22.5 | 29.5 |
| UO2 (AO/AOS) | 40.4 | 28.1 | 22.1 | 29.4 |
| Polysorbate 20 | 40.4 | 26.7 | 22.5 | 28.7 |

After considering Tables 2 and 3, as well as FIGS. 1-4, for highest average flux for the entire simulated milk production run, the following chemistries were chosen due to their high performances on both PES and PVDF membranes: PEG 1450, LAEO 91-6, Guerbet XP-50, and Alkyl C6 Glucoside. For the purposes of comparison the following in-line chemistries were selected for further evaluation as well: NPE 9.5 (U01), TDA-9 (U06), AO/AOS (U02), and LAS (U83).

The following Table 4 shows the structures and physical properties of the chemistries which were selected for further evaluation. The surfactant list contains branched and non-branched structures all of which have different properties. Highly branched surfactants like Guerbet XP-50 produce less foam and have lower dynamic surface tension than surfactants with less branching. It is believed that some of the branching structures perform better on the membranes. Our theories of functionality based on molecular structure are as follows:

Large molecules and extensive branching may foul or plug the membranes depending on the molecular weight cut-off of the particular membrane Small molecules with little branching may allow these molecules to rinse easily and not affect the membrane surface characteristics such as zeta potential or reduced surface tension which can improve the wetting characteristics Molecules with certain amount of branching and molecular weight may interact with the membrane surface modifying it to improve the wetting and permeation characteristics.

As an example, PEG 1450 is a food grade polymer which was discovered to have a positive effect on membrane production performance and may be dictated in part by its molecular weight. It is also possible that the higher molecular weight PEG 4000, which during testing did not have as positive effect as PEG 1450, may be too large and plugged the membrane surface and thus slowed the permeation rate. Conversely, the PEG 300 which was tested may have been too small and thus permeated through the membrane at a faster rate than the PEG 1450, thus negating any positive effects PEG compounds might have on membrane performance such as improving the hydrophilic characteristics of the surface.

TABLE 4

Properties of selected chemistries

| Chemistry | Surfactant | HLB | Pour Point ° C. | CMC % m/m | Physical Form | Cloud Point (° C.) | Draves Wetting time (seconds) | Biodegradability |
|---|---|---|---|---|---|---|---|---|
| PEG 1450 (polyethylene glycol MW = 1450) 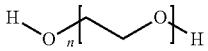 | No | N/A | Solid (melt point 43-46 C.) | N/A | solid | N/A | N/A | Food Grade |
| LAEO 91-6 (C9-11 linear alcohol with 6 moles of ethoxylation) Linear $C_9$-$C_{11}$ alkyl 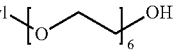 | Yes | 12.4 | 6 | 0.029 | liquid | 52 | N/A | Readily Biodegradable, >60%-70% |
| Guerbet XP-50 (BASF) 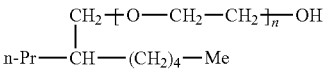 | Yes | 10 | 25 | N/A | liquid | 56-60 C. | 5 | Readily Biodegradable, >60%-70% |
| Alkyl C6 Glucoside 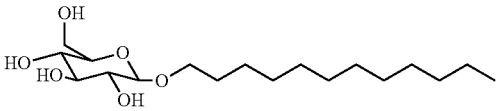 MW = 520-600 | Yes | 14.6 | −9 | N/A | liquid | N/A | N/A | Readily Biodegradable, >60%-70% |
| NPE 9.5 (nonyl phenol with 9.5 moles of ethoxylation) 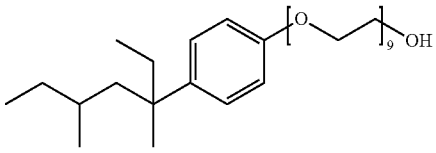 | Yes | 13.1 | −1 | 48 | liquid | 54 | 0.04 | Not Readily Biodegradable Known Toxicity to Aquatic Environments |
| TDA-9 (iso-tridecyl alcohol with 9 moles of ethoxylation) $HO-[CH_2-CH_2-O]_n-(C_{13}H_{27}\text{-iso})$ | Yes | 13.3 | 18 | N/A | liquid | 55 | 5.3 | Readily Biodegradable, >60%-70% |

TABLE 4-continued

Properties of selected chemistries

| Chemistry | Surfactant | HLB | Pour Point ° C. | CMC % m/m | Physical Form | Cloud Point (° C.) | Draves Wetting time (seconds) | Biodegradability |
|---|---|---|---|---|---|---|---|---|
| LAS (Linear Alkyl Benzene Sulfonate) $CH_3(CH_2)_5CH(CH_2)_4CH_3$ 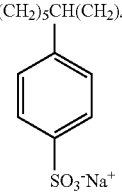 $SO_3^-Na^+$ | Yes | 12.3 | −10 | 0.025 | liquid | N/A | .025 | Highly Biodegradable, >99% |
| AO (lauryl dimethyl amine oxide) 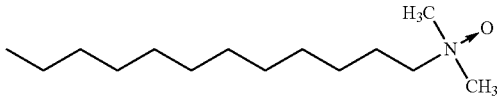 | Yes | N/A | −10 | N/A | liquid | N/A | N/A | Readily Biodegradable, >60%-70% Known Toxicity to Aquatic Environments |
| AOS (alpha olefin sulfonate) $R—CH=CH$ $\vert$ $SO_3^-Na^+$ | Yes | N/A | −3.8 | N/A | Liquid | N/A | N/A | Readily Biodegradable, >90% Non-Toxic |

Figure 5:
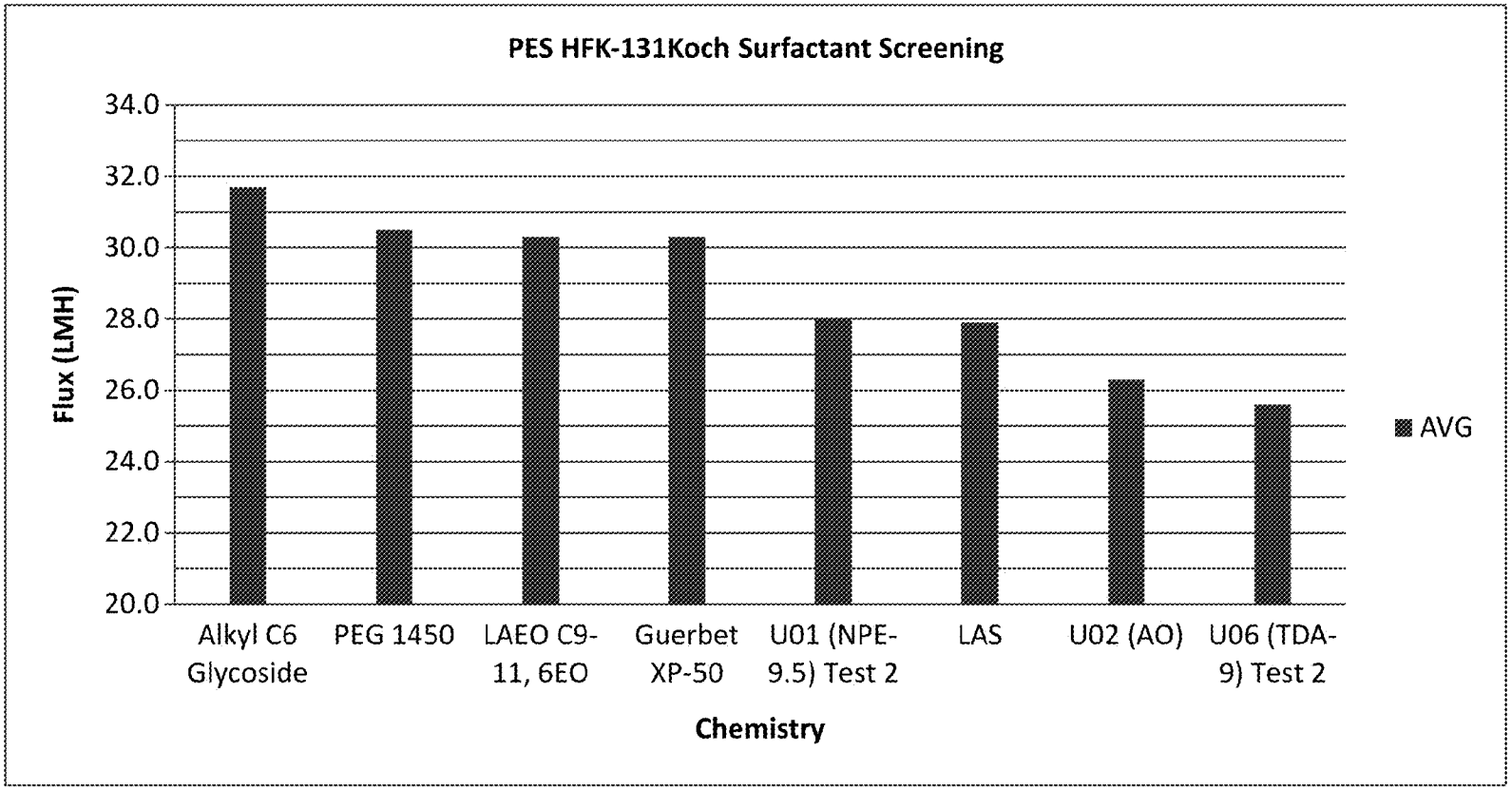
FIG. 5 is a graphs showing the average production flux for PES membranes. In this case, the four new chemistries tested had a 9-25% higher flux over the course of the entire production run than the four in-line chemistries.

FIG. 5 shows the average production flux for PES membranes. In this case, the four new chemistries tested had a 9-25% higher flux over the course of the entire production run than the four in-line chemistries. A 9-25% increase in flux rates could result in improved production time of 2-5 hours assuming a 20 hour production day. It is believed anything greater than 10% difference in flux rates can be considered significant for industrial applications.

Figure 6:
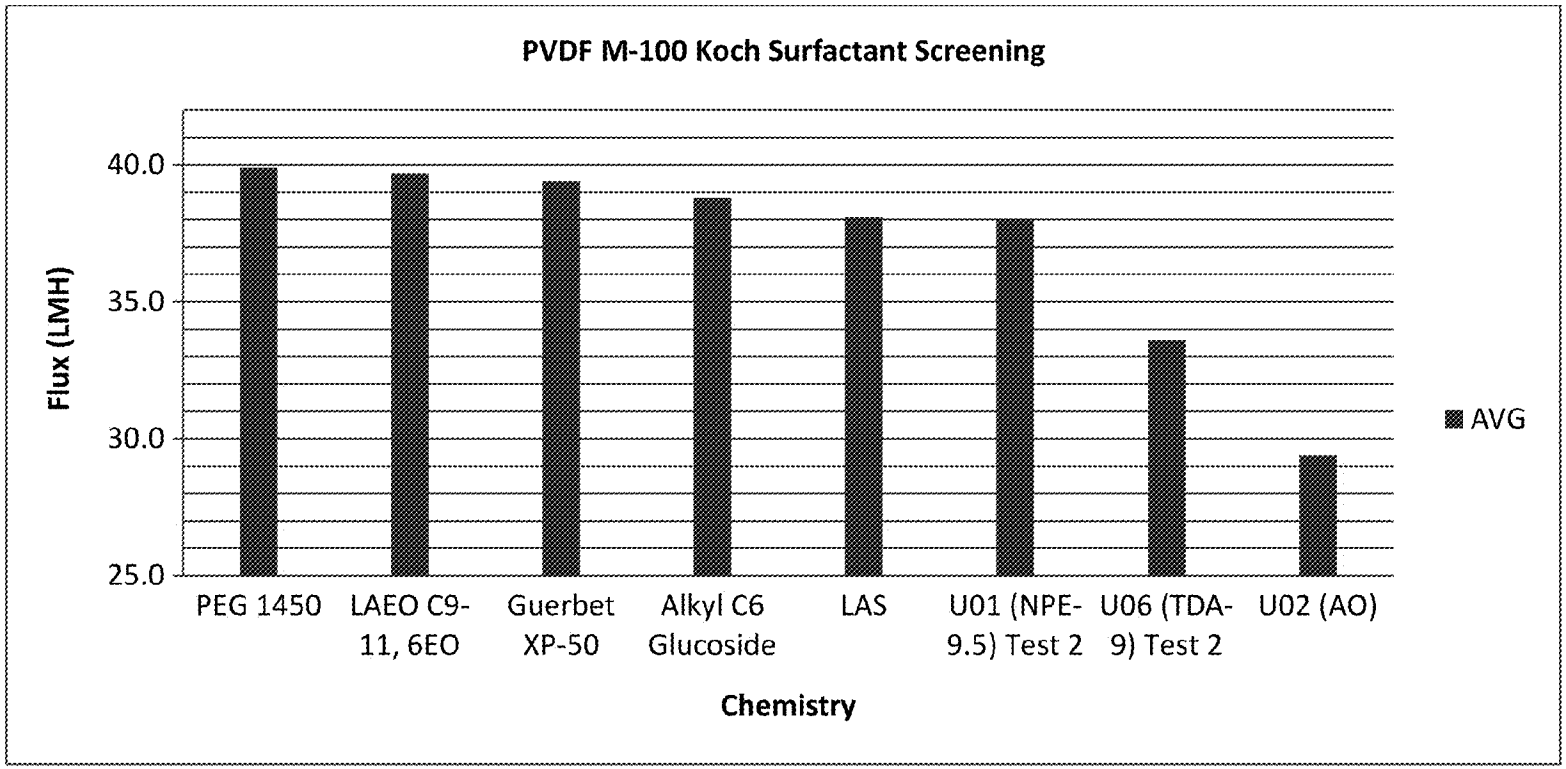
FIG. 6 is a graph showing the average production flux for PVDF membranes. Similar to FIG. 5, the four highest performing chemistries outperformed the four in line chemistries by a range of 1-36% when looking at highest average flux during the course of a simulated production run.

FIG. 6 shows the average production flux for PVDF membranes. Similar to FIG. 6, the four highest performing chemistries outperformed the four in line chemistries by a range of 1-36% when looking at highest average flux during the course of a simulated production run. However, in the case of the PVDF membranes, the PEG 1450 was the top performer and the Alkyl C6 Glucoside was fourth best. This is opposed to PES membranes in which the Alkyl C6 Glucoside and PEG 1450 are number one and two performing chemistries respectively.

Figure 7:
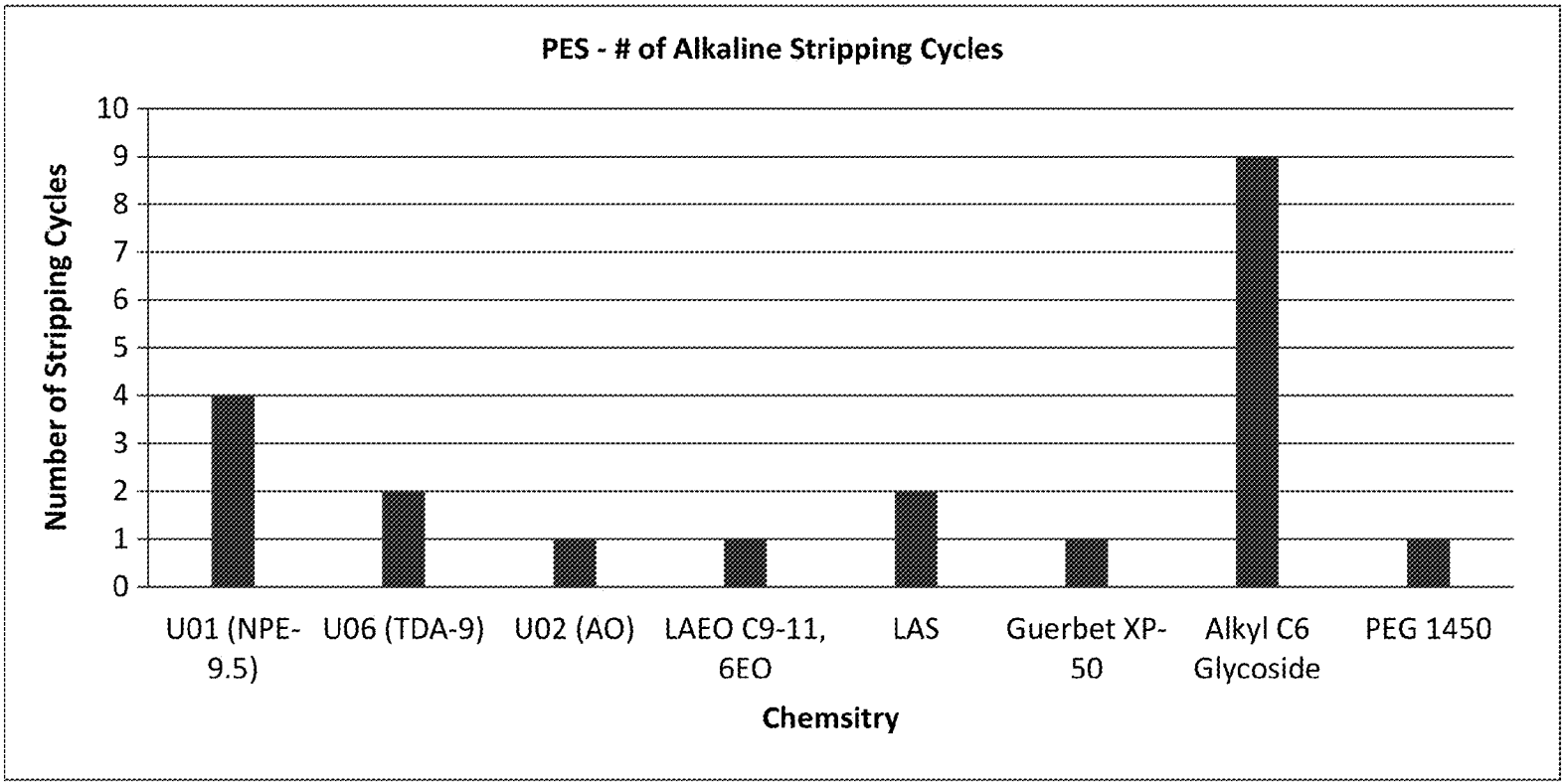
FIG. 7 shows the number of alkaline "stripping" cycles on PES membranes used to achieve a baseline of 275 LMH before screening the next set of chemistries.

FIG. 7 shows the number of alkaline "stripping" cycles used to achieve a baseline of 275 LMH before screening the next set of chemistries. Alkyl C6 Glucoside took nine cycles, in which the last cycle also consisted of using a 0.6% w/w active solution of LAEO 91-6. This allowed for the removal of the Alkyl C6 Glucoside from the membranes and the return of the CWF to baseline values using a surfactant to clean a surfactant in essence. NPE-9.5, TDA-9, and LAS all take multiple cycles to reach baseline again, whereas AO/AOS, LAEO 91-6, Guerbet XP-50 and PEG 1450 all only require 1 alkaline cycle to reach the required CWF baseline. An increase in stripping cycles indicates poor rinse characteristics on that particular surfactant/membrane combination and should be used with caution.

It is possible that poor rinsing characteristics could result in two scenarios:

1. Too much residual surfactant could act as a foulant causing poor permeation during production and/or CWF or conversely
2. The residual surfactant could have a positive impact on production and/or CWF due to a positive surface modification such as modifying to a more hydrophilic surface.

It is also possible that good rinsing characteristics result in two scenarios:

1. A surfactant free membrane performs well in production and CWF since there is no "foulant" remaining.
2. A surfactant free membrane performs poorly in production and CWF since there is no surface modification due to the lack of residual surfactant.

Figure 8:
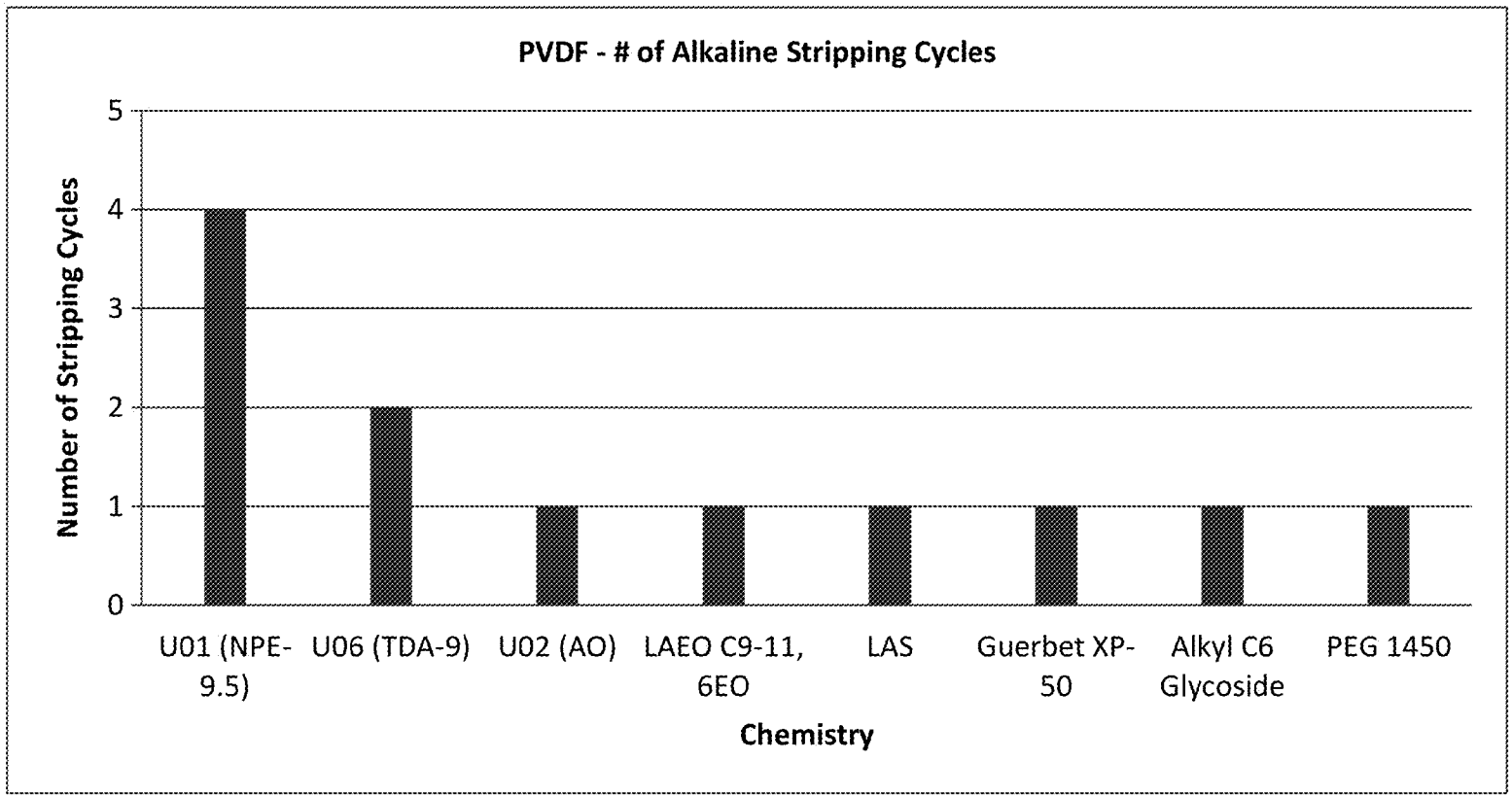
FIG. 8 is a graph showing the number of alkaline stripping cycles to return to baseline CWF on PVDF membranes.

FIG. 8 shows the number of alkaline stripping cycles to return to baseline CWF on PVDF membranes. This shows that NPE-9.5 and TDA-9 are the only chemistries that require more than one alkaline wash cycle to return the membrane to the baseline level of CWF. This is likely due to the low surface tension of the PVDF surface and a possible indication as to why PVDF is often used to minimize fouling in high fat applications.

Fat Soil Stainless Steel Coupon Cleaning

This protocol is taken directly from the F&B Standard Protocol for Thin Film Dairy Soil Removal. The following adjustments were made for this study: Cleaning Temperatures were set at 118 F and allowed to clean for 30 minutes to simulate membrane cleaning. Surfactants were used at 0.6% w/w concentration with the addition of 0.1% w/w of U131 to provide alkalinity as in previous tests. Results in Table 7 indicate that the best chemistries for the removal of dairy butterfat soil from stainless steel coupons are NPE 9.5, TDA- 9, LAEO 91-6, Guerbet XP-50, and AO/AOS. The poorest performers in this particular test were LAS, APG, and PEG 1450. Due to the importance of dairy soil removal properties of any replacement for NPE 9.5, it is obvious from this screening list that any such replacement would benefit by containing LAEO 91-6, Guerbet XP-50, and some of the other surfactants/polymers that adequately cleaned these coupons. It also surprisingly demonstrates that poor cleaning surfactants and polymers do not predict that they will have a negative effect on the membrane. Interestingly is that some surfactants/polymers that cleaned poorly, performed very well on the membrane. An example is PEG 1450 polymer which does not act as a surfactant and does not clean fatty soils effectively, but allows the membrane to function very well after contacting the membrane.

TABLE 7

SS Coupon Butterfat Removal for Various Surfactants and Alkalinity

| CHEMISTRY (30 min, 118 F., 0.1% w/w U131 + 0.6% w/w active surfactant | VISUAL RESULTS | MEMBRANE PERFORMANCE |
|---|---|---|
| NPE 9.5 (U01) | Good Removal | Good |
| TDA-9 (U06) | Good Removal | Poor |
| AO/AOS (U02) | Good Removal | Poorer |
| LAS (U110 or U83) | Poor Removal | Poorer |
| LAEO 91-6 | Good Removal | Good |
| Guerbet XP-50 | Good Removal | Good |
| Alkyl C6 Glucoside | Poor Removal | Good |
| PEG 1450 | Poor Removal | Good |

Conclusions

It is paramount that any possible replacement for the use of NPE 9.5 in membrane systems must have equal or higher performance than NPE 9.5 on membrane production, cleaning performance, rinsing properties, foaming properties, cost, formulation stability, ease of use, and membrane compatibility. The ideal replacement for U01 (NPE 9.5) will have all of these properties, which as per the data presented will require a blend of multiple surfactants and chemistries that are designed to achieve a complex combination of benefits.

Example 2

Attempts to generalize various surfactants with ability to perform in the membrane cleaning functions of the invention have shown that there seem to be no clear generalizations and a particular surfactants ability to function is unpredictable.

Figure 9:
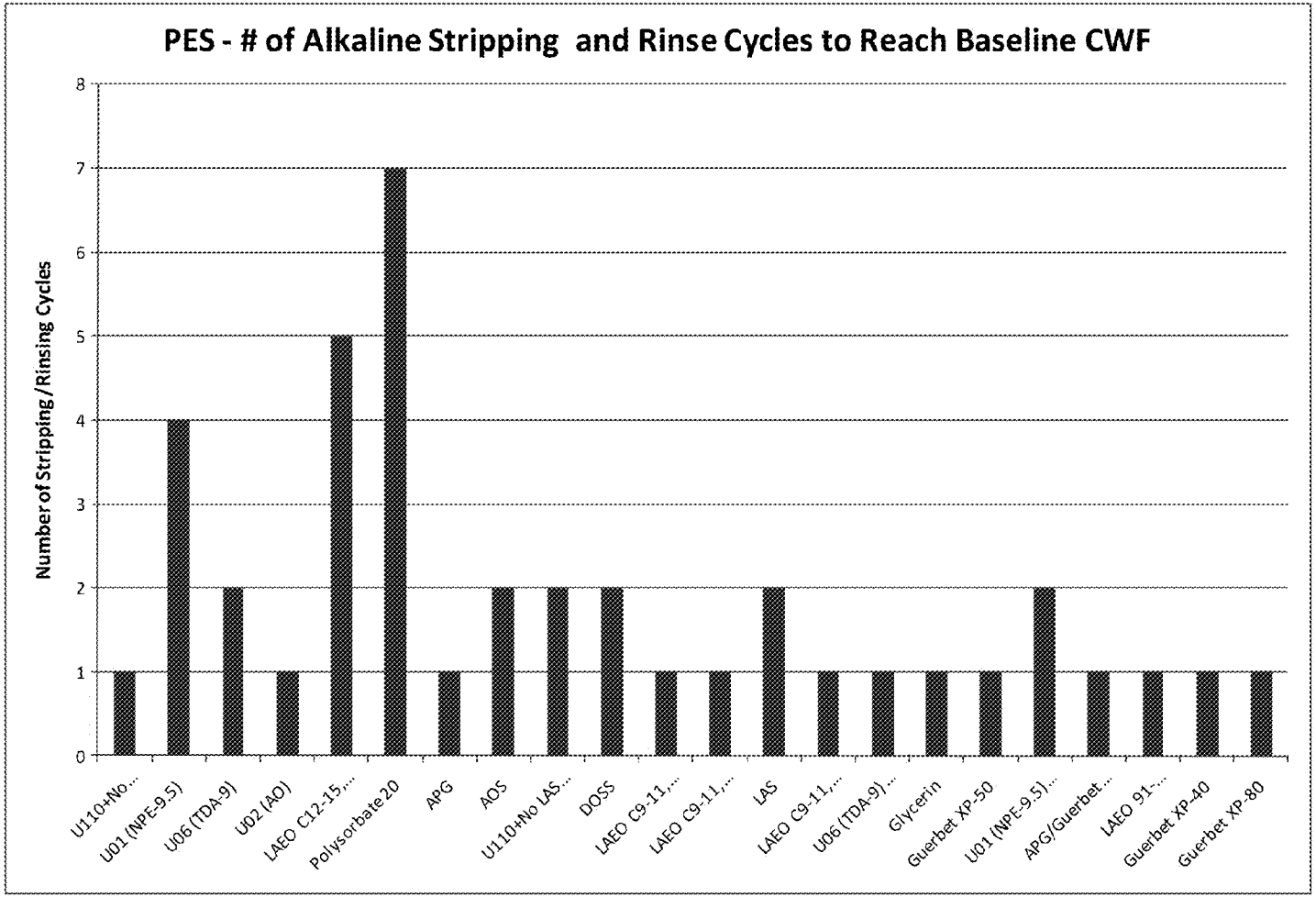
FIG. 9 is a graph showing the showing the number of stripping and rinsing cycles need to reach baseline for a polyethersulfone (PES) membrane.
Figure 10:
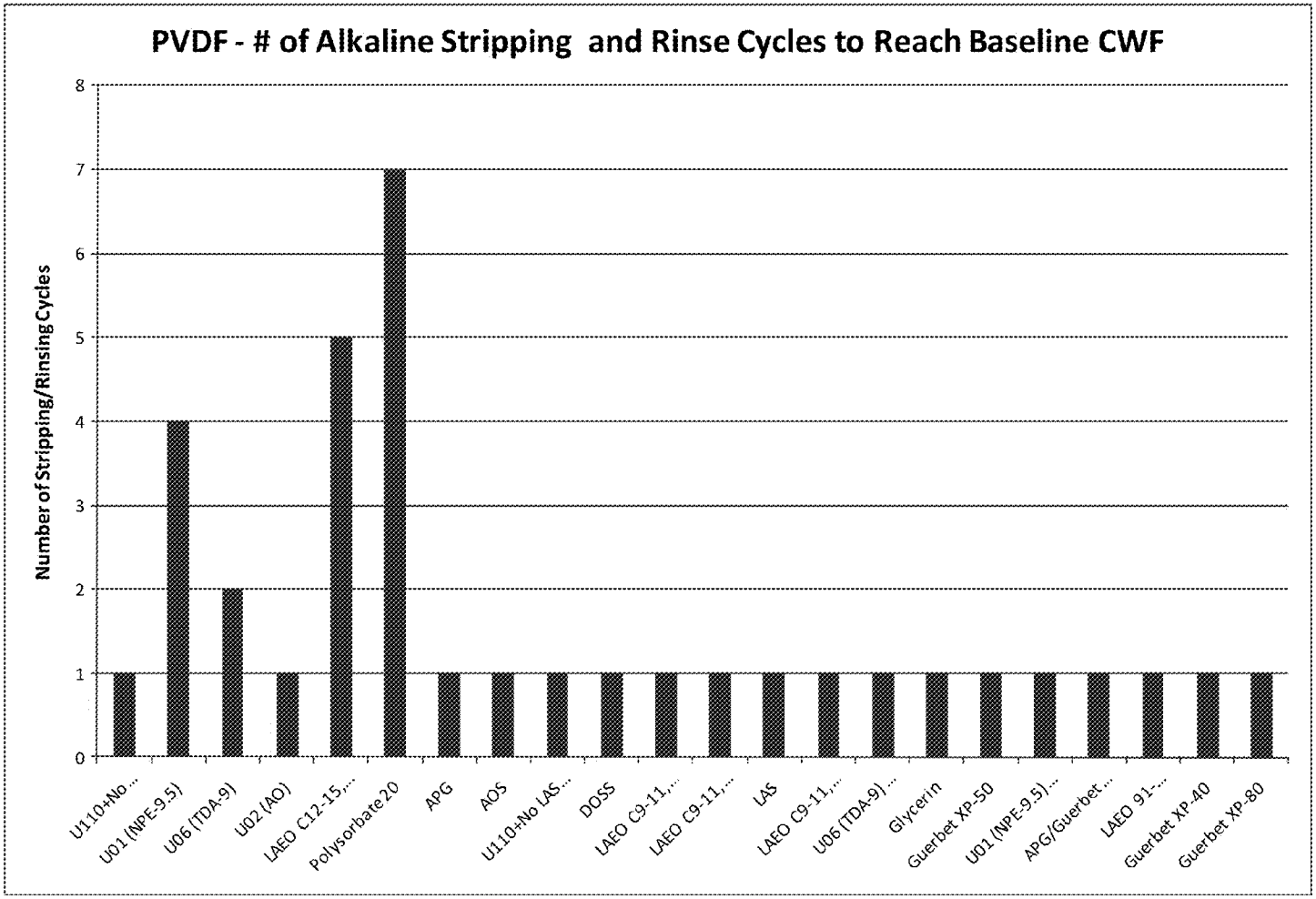
FIG. 10 is a graph showing the showing the number of stripping and rinsing cycles need to reach baseline for a polyvinylidene difluoride (PVDF) membrane.

For example, attempts were made to generalize surfactants based upon ability to rinse from the membrane. FIG. 9 shows that for PES membranes polysorbate 20 and LAEO 12-15 (7EO) had poor rinse characteristics (highest number of stripping/rinsing cycles and performed poorly on the membrane cleaning test, (FIG. 2). FIG. 10 shows that this trend also exists for PVDF membranes, see also FIG. 1. However, hexyl glucoside performed well on the membrane during production, but rinsed poorly. This is a likely candidate as a unique co-surfactant to this booster system.

There are a number of theories of functionality based on molecular structure of the surfactant/polymer and membrane. The higher the molecular weight and extensive branching of the surfactant and polymer, the higher the propensity to foul or plug the membranes depending on the molecular weight cut-off of the particular membrane and the surface energy of the particular surface being treated. However, die data demonstrates that the size of the molecule and degree of branching does not consistently provide predictive results. The PES membrane tested has a Molecular Weight Cut-Off (MWCO) of 5,000 to 10,000 and therefore it was believed that the PEGs likely don't permeate as well on these membranes as compared to UF PVDF membranes that have a MWCO of 50,000 to 10,000. Small molecules with minor branching may allow these molecules to rinse easily and not affect the membrane surface characteristics such as zeta potential or reduced surface tension which can improve the wetting and hydrophilicity characteristics. Molecules with certain amount of branching and molecular weight may interact with the membrane surface modifying it to improve the wetting and permeation characteristics.

As an example, PEG 1450 has a positive effect on membrane production performance which could be in part due to its molecular weight. It is also possible that the higher molecular weight PEG 4000, which during testing had a poorer effect, may be too large and "plugged" the membrane and thus slowed the permeation rate. Conversely, the PEG 300 which was tested may have been too small and thus permeated through the membrane at a faster rate than the PEG 1450, thus negating any positive effects PEG compounds might have on membrane performance. See FIGS. 1 and 2. PEG 1450 had the best membrane performance while PEG 4000 had poorer membrane performance, while PEG 300 was the least effective.

Example 3

Glue Line Testing and Contact Angle

Figure 11:
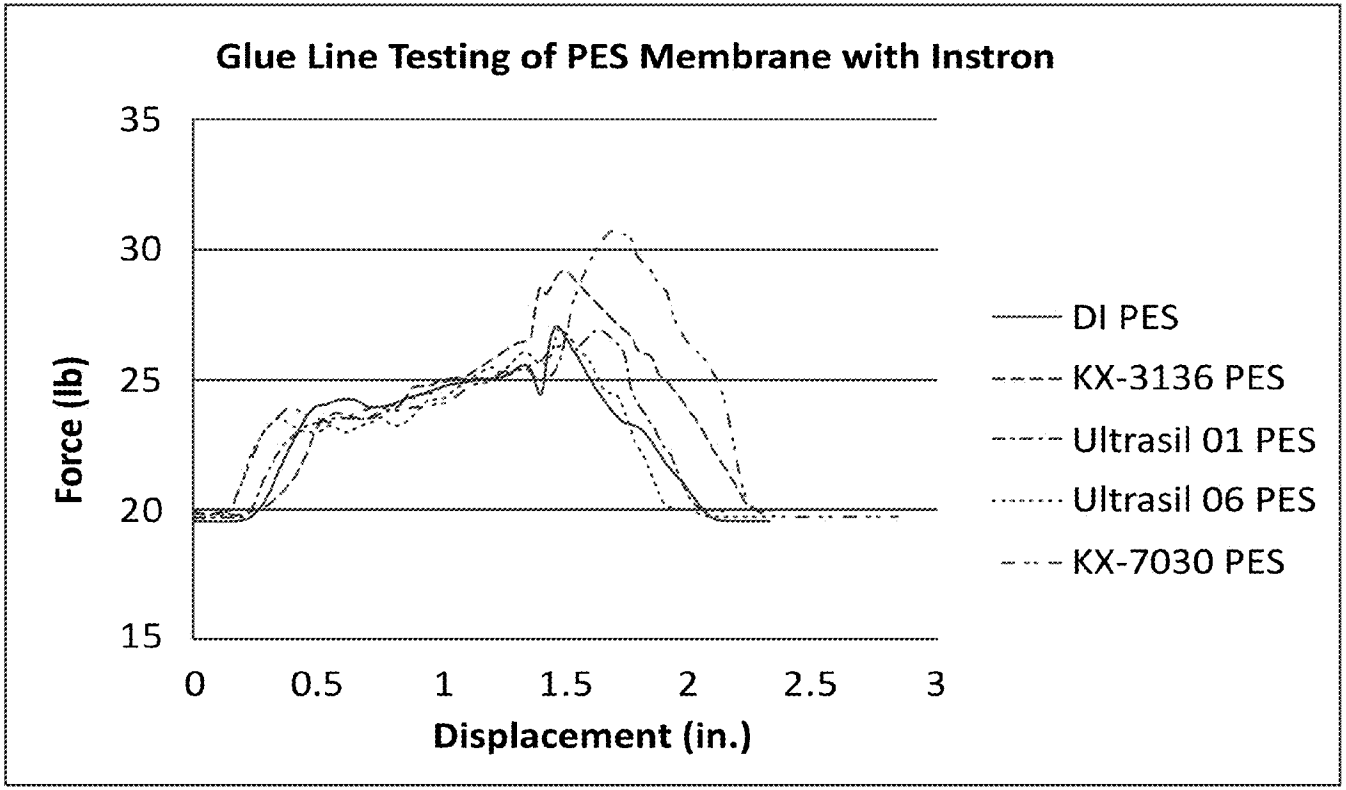
FIG. 11 is a graph showing glue line testing of PES membranes force verses displacement.
Figure 12:
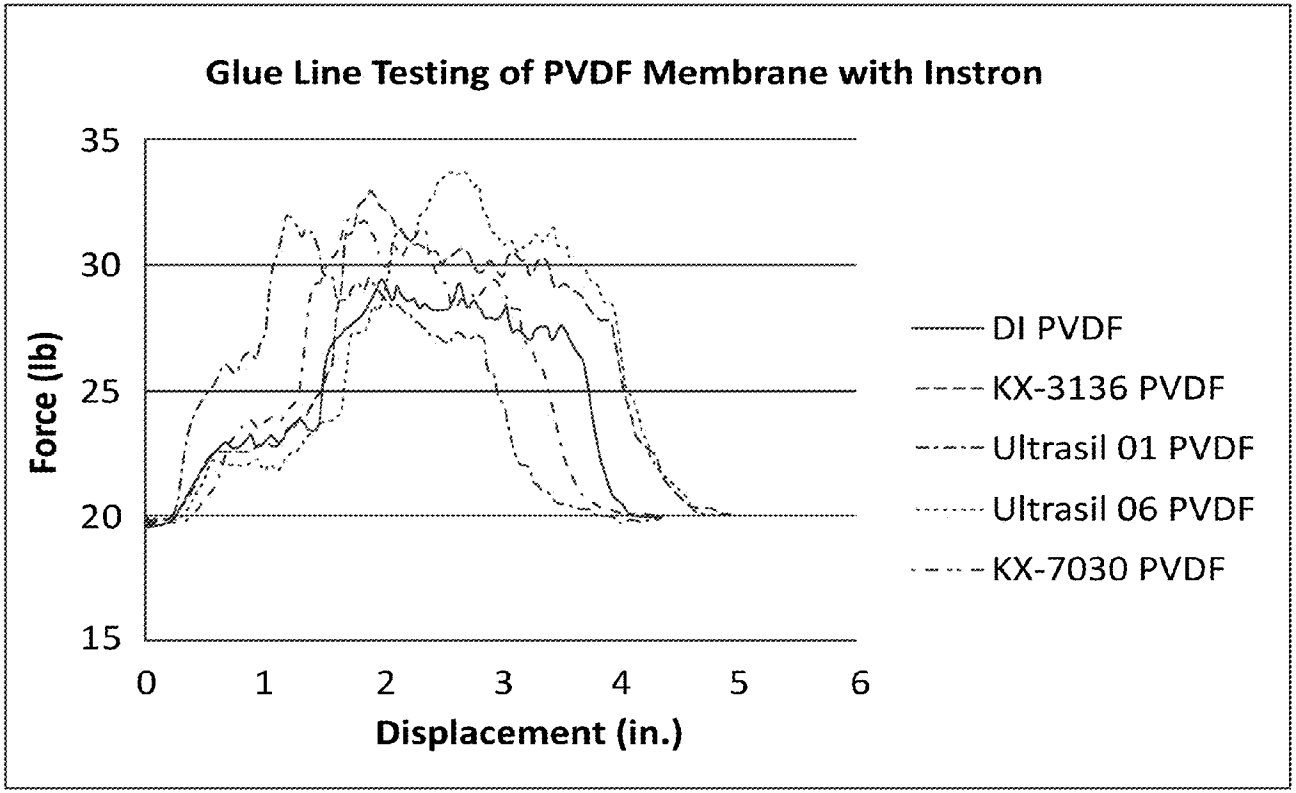
FIG. 12 is a graph showing glue line testing of PVDF membranes forces verses displacement.

Polymeric membranes have glue lines that can be susceptible to penetration by aggressive surfactant and/or solvent solutions. Applicants tested the compositions of the invention in this scenario. The results are show in FIGS. 11 and 12 (higher is better). From the figures, one can see that KX-7030 is better on this PES membrane (FIG. 11) in FIG. 12 for the PVDF membrane, one cart see that KX-7030 is about the same. This suggests that KX-7030 is acceptable and in some cases is better than Ultrasil 01 (NPE) or Ultrasil 06 (TDA)

Next contact angle was investigated.

Figure 13:
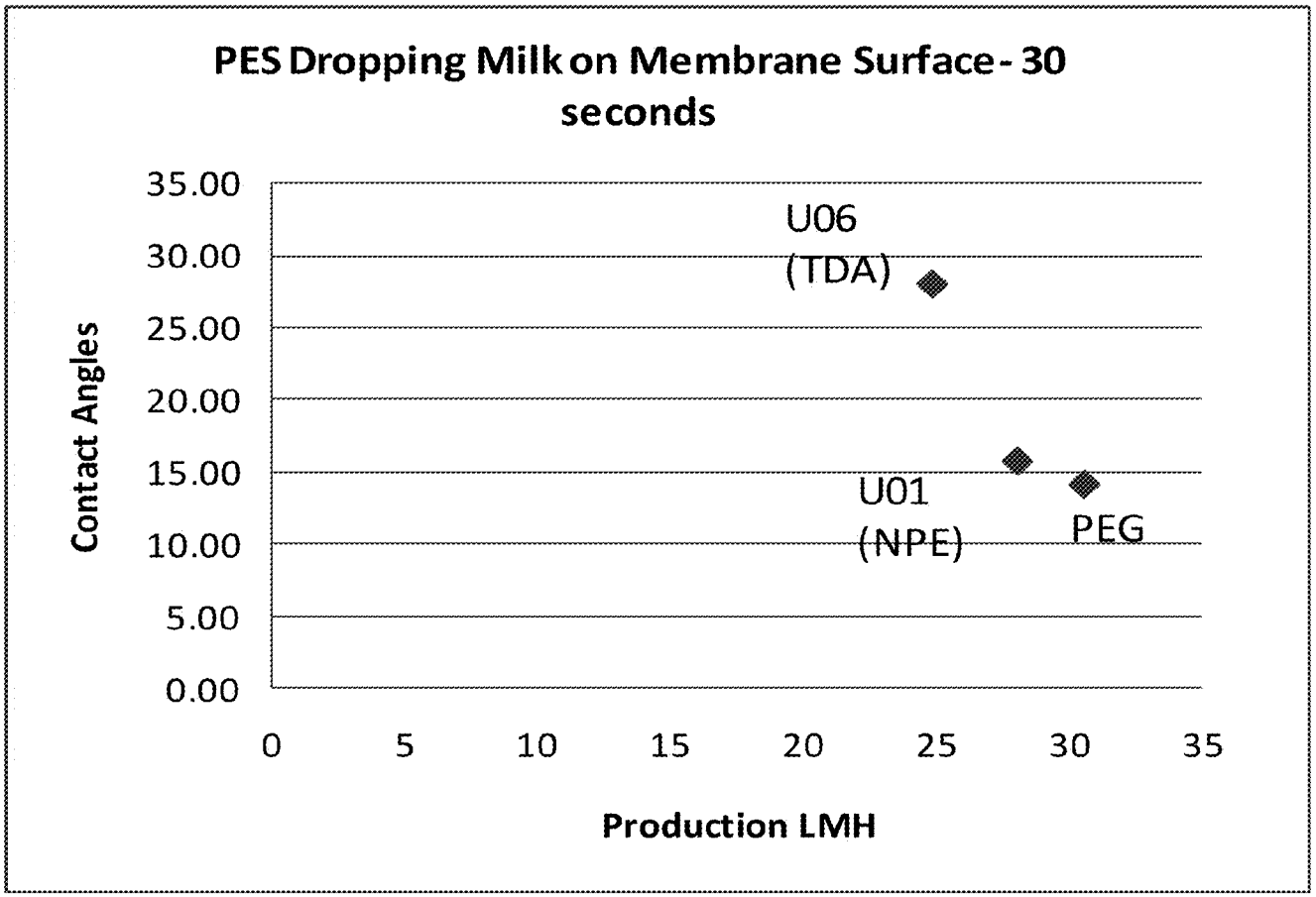
FIG. 13 is a graph showing PES membranes with dropping milk on membranes with the contact angle versus production.
Figure 14:
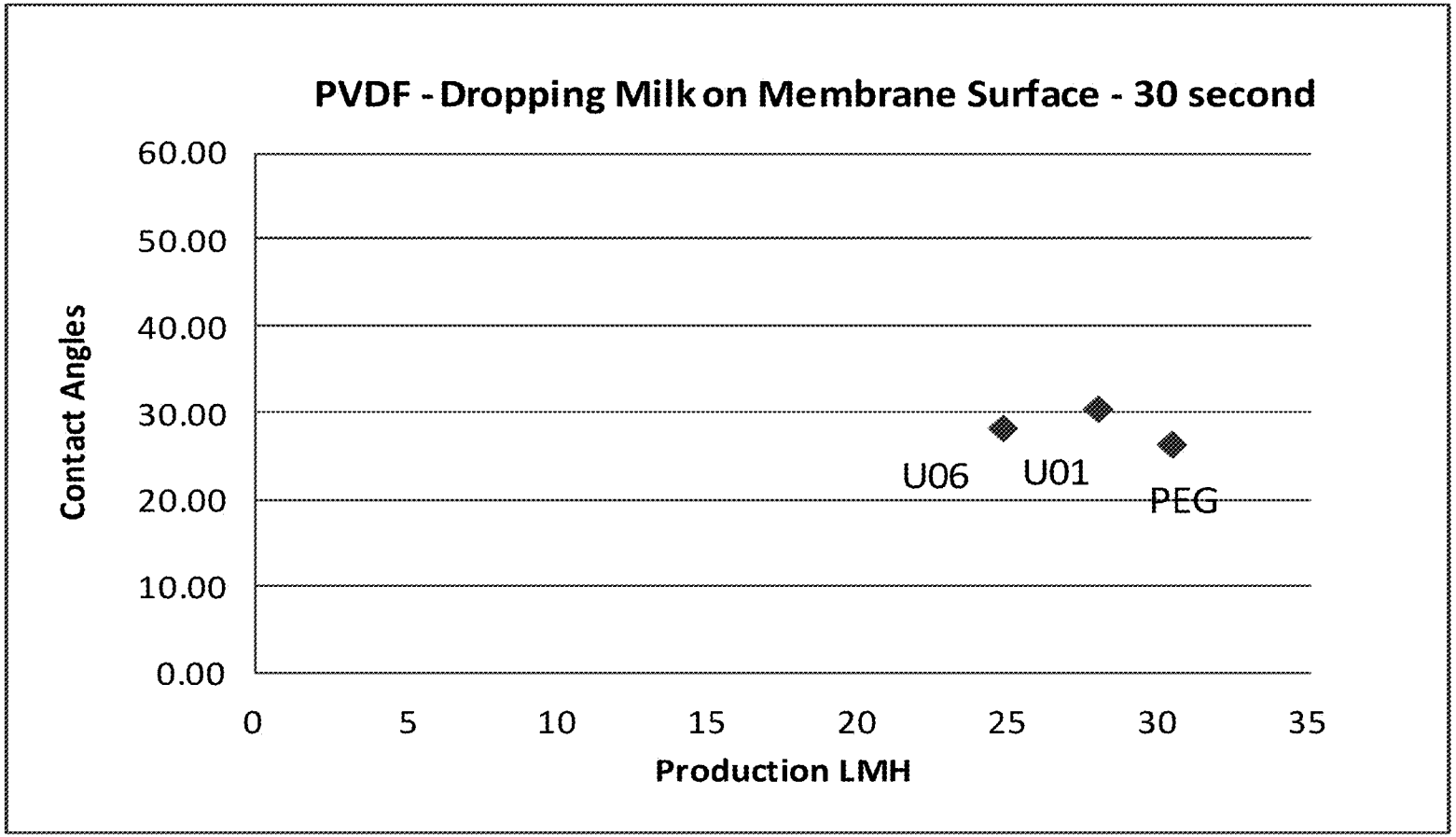
FIG. 14 is a graph showing contact angle per above on PVDF membranes.

Contact angles were also used to predict performance. During the PES testing, it appeared high contact angles greater than 25, such as the case was with poor performing U06 (TDA), and lower contact angles of less than 25 such as good performing PEG and NPE adequately predict performance on the membrane. For the higher molecular weigh cutoff PVDF membranes, contact angles did not adequately predict membrane performance for various surfactants and polymers (see FIGS. 13 and 14).

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present inventions intended to embrace all such alternatives, modifications, and variations as fall within the scope of the claims, together with all equivalents thereof.

What is claimed is:

1. A method for cleaning a membrane filter system comprising:

washing said membrane with a composition comprising a surfactant booster comprising at least three or more of the following surfactants, nonionic polymers, surfactant blends, or surfactant/nonionic polymer blends:

PEG 1450/hexyl glucoside blend (50/50); hexyl glucoside; PEG 1450; a lauryl dimethyl amine oxide; a C9-11 linear alcohol with 6 moles of ethoxylation; an alkoxylated Guerbet alcohol; PEG 4000; polycarboxylated alcohol; PEG 1450/alkoxylated Guerbet blend (50/50); PEG 1450/hexyl glucoside (50/50); hexyl glucoside/alkoxylated Guerbet blend (50/50); PEG 1450/C9-C11 linear alcohol with 6 moles ethoxylation blend (50/50); Guerbet XL-70; a blend of C9-C11 linear alcohol with 6 moles ethoxylation and a C9-11 linear alcohol with 8 moles ethoxylation (50/50); PEG 300; PEG 1450/hexyl glucoside/alkoxylated Guerbet blend (40/40/20); linear alkyl benzene sulfonate; C9-C11 linear alcohol with 8 moles ethoxylation; Polysorbate 20; C9-C11 linear alcohol with 6 moles ethoxylation/hexyl glucoside blend (50/50); Dioctyl sulfosuccinate; C12-C15 linear alcohol with 7 moles ethoxylation; C9-C11 linear alcohol with 6 moles ethoxylation/alkoxylated Guerbet (50/50); and Alpha olefin sulfonate; wherein said surfactant booster contains less than about 0.5% by weight nonyl phenol ethoxylate.

2. A method according to claim 1, wherein the membrane is fouled with a food, water, beverage, or brewery product.

3. A process according to claim 1, wherein the membrane is fouled with a dairy product.

4. The method of claim 1 wherein said composition further comprises water.

5. The method of claim 1 wherein said surfactant booster creates a contact angle of less than 30 degrees on PES membranes.

6. The method of claim 1 wherein said surfactant booster creates a contact angle of less than 35 degrees on PVDF membranes.

7. A method according to claim 1, further comprising washing said membrane with a source of alkalinity.

8. The method of claim 7 wherein said washing occurs prior to, simultaneous with or after said surfactant booster wash step.

* * * * *